US006292154B1

(12) United States Patent
Deguchi et al.

(10) Patent No.: US 6,292,154 B1
(45) Date of Patent: Sep. 18, 2001

(54) ANTENNA DEVICE

(75) Inventors: Futoshi Deguchi; Kazuyuki Nakashima, both of Fukuoka; Sumio Tate, Kasuga, all of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/255,838

(22) Filed: Feb. 23, 1999

(30) Foreign Application Priority Data

Jul. 1, 1998 (JP) ..... 10-185980

(51) Int. Cl.[7] ..... H01Q 1/36
(52) U.S. Cl. ..... 343/806; 343/795
(58) Field of Search ..... 343/806, 795; H01Q 1/36

(56) References Cited

U.S. PATENT DOCUMENTS

| | | | | |
|---|---|---|---|---|
| 4,464,663 | | 8/1984 | Lalezari et al. | 343/700 MS |
| 4,849,765 | | 7/1989 | Marko | 343/702 |
| 4,987,424 | * | 1/1991 | Tamura et al. | 343/806 |
| 5,936,583 | * | 8/1999 | Sekine et al. | 343/702 |

FOREIGN PATENT DOCUMENTS

| | | | | |
|---|---|---|---|---|
| 0777293A1 | * | 6/1997 | (EP) | H01Q/1/36 |
| 0690108 | | 3/1994 | (JP) . | |
| WO9627219 | | 9/1996 | (WO) . | |

OTHER PUBLICATIONS

European Search Report dated Mar. 1, 2000.
Patent Abstract of Japan, JP 05 291 825 A, Nov. 5, 1993.
Patent Abstract of Japan, JP 11 251 825 A, Sep. 17, 1999.
European Search Report dated Nov. 5, 1999.
Patent Abstract of Japan, JP 05 291 825, Nov. 5, 1993.

* cited by examiner

*Primary Examiner*—Michael C. Wimer
(74) *Attorney, Agent, or Firm*—Stevens, Davis, Miller & Mosher, LLP

(57) ABSTRACT

An antenna device includes radiation elements formed on a common antenna board, a feeding unit for feeding the radiation elements, and a ground plate provided in electrically-spaced relation to the radiation elements. The ground plate is mounted on a box-like metal body to form a short-circuit therewith. The radiation elements may have different line lengths for transmitting and receiving a plurality of wavelengths. The feeding unit may include a first radiation element having a different electrical length than a second radiation element, a first feed point for feeding electric power to the first radiation element, and a second feed point for feeding radiation elements are grounded to the ground plate at respective first and second ground points. The difference from the first and second feed points to their respective ground points are different from one another. The antenna device may have a value equal to (H)÷(Λ), where (H) is the distance between the radiation elements and the ground plate, and (Λ) is a wavelength of at least one frequency transmitted or received by the antenna device, and the distance H satisfies a relationship of 1÷250≦(H)÷(Λ)≦1÷100.

22 Claims, 30 Drawing Sheets

ANTENNA DEVICE

BACKGROUND OF THE INVENTION

1. Field of the Invention

This invention relates to an antenna device of a compact, thin design having wideband frequency characteristics.

2. Description of the Related Art

Recently, mobile satellite communications, using a mobile means (e.g. an airplane, a ship or a car) and a communication satellite, have come into wide use. With the spread of the mobile satellite communications, there has now been a stronger demand for a compact, high-performance antenna. As is well known, in order to achieve a compact antenna design, there has been proposed a meandering-type antenna in which a radiation element of the antenna comprises a wire-like conductor formed or bent into a meandering configuration. One example of such antenna is disclosed in JP-A-6-90108.

Generally, the frequency bandwidth of a conventional antenna is about several % in terms of the specific band, and when the length of a radiation element was reduced so as to achieve a compact design, a problem was occurred that the band was further narrowed. When the transmitting band and the receiving band were larger than the specific band thereof, a problem was occurred that a plurality of antennas for transmitting and receiving purposes were required.

FIGS. 13A to 13B are a plan view showing the construction of a conventional antenna, FIGS. 13B and 13C are views showing the installation of the conventional antenna, and FIG. 13D is a graph showing resonance characteristics of the conventional antenna. The resonance frequency of the conventional antenna is a single resonance, and therefore the conventional antenna can not deal with a plurality of frequency bands (that is, the frequency band between 137.0 MHz and 138.0 MHz for a down-line and the frequency band between 148.0 MHz and 150.05 MHz for an up-line) assigned to a mobile satellite communication system which effects a ground-satellite-ground data communication using a satellite orbiting in a low orbit. Namely, the resonance frequency fr is determined by the length L of a radiation element, and this has resulted in a problem that the resonance occurred only for the single frequency.

In the installation of the antenna on a mobile means such as a vehicle, it is desirable that the antenna should have a low posture (reduced antenna height) in order to reduce the wind pressure, acting on the antenna open surface, and also to prevent damage to the antenna upon contact with other objects. Particularly, when the antenna is installed on a container, the antenna height is about 0.5 m as a result of the stacking of the containers even if the above ¼-wavelength grounded-type antenna is used, and therefore the installation of the antenna is impossible. If the conventional antenna, shown in FIG. 13A, is mounted vertically on the vehicle body as shown in FIG. 13B, in addition to the above bandwidth problem, further problems concerning the reduction of the wind pressure and the damage to the antenna upon contact with other object will be occurred. If the antenna is mounted horizontally on the vehicle body as shown in FIG. 13C, the impedance is lowered as the antenna approaches an electrically-conductive panel or plate of the vehicle body, and also the resonance frequency is shifted, so that the impedance matching between the antenna and the feeder line is adversely affected, which has resulted in a problem that the transmitting and receiving operation can not be operated.

SUMMARY OF THE INVENTION

It is an object of this invention to provide an antenna device which can deal with more frequencies, and has a compact design and a low posture, and is hardly influenced by a box-like metal body such as a vehicle body.

In order to achieve the object of present invention an antenna device of the present invention comprising radiation elements, feed means for feeding electric power to the radiation elements, a ground plate, and a cover member covering the radiation elements and the feed means, which is mounted on metal cubic and using short circuit between ground plate and metal cubic, wherein a value, obtained by dividing the distance (H) between the radiation elements and the ground plate by a wavelength (Λ), is $1\div250 \leqq H\Lambda \leqq 1\div80$, and preferably $1\div200 \leqq H\div\Lambda 1\div100$.

With this construction, an overall loss of the antenna can be suppressed while suppressing the decrease of the antenna impedance, and therefore there can be provided the antenna device of high reliability which can positively operate under a wide range conditions of use.

The plurality of radiation elements and the feed equipment are formed on a common antenna board, and therefore as compared with the case where such elements are formed on separate boards, the antenna construction can be simplified, and the productivity can be enhanced, and besides the compact, thin design of the antenna can be achieved. Furthermore, since the different line lengths are provided, a plurality of wavelengths can be transmitted and received.

Particularly, by setting the line length to about 25% of the corresponding wavelength, the optimum transmitting and receiving operation becomes possible corresponding to wavelength, and also the polarization characteristics of the antenna can be enhanced.

Electric power is fed to the plurality of radiation elements through the single feed equipment, and therefore the area of the antenna board, which is occupied by the feed equipment can be reduced, then the antenna board size can be reduced. Besides, since the power is fed to the plurality of radiation elements through the common feed equipment, the power can be fed to the plurality of radiation elements under the same condition, and therefore there can be provided the antenna of high reliability having excellent antenna characteristics each frequency to which the plurality of radiation elements correspond, respectively.

DESCRIPTION OF THE PREFERRED EMBODIMENTS

Preferred embodiments of the present invention will be described below.

First Embodiment

A first embodiment of an antenna device of the present invention will now be described with reference to the drawings.

Figure 1:
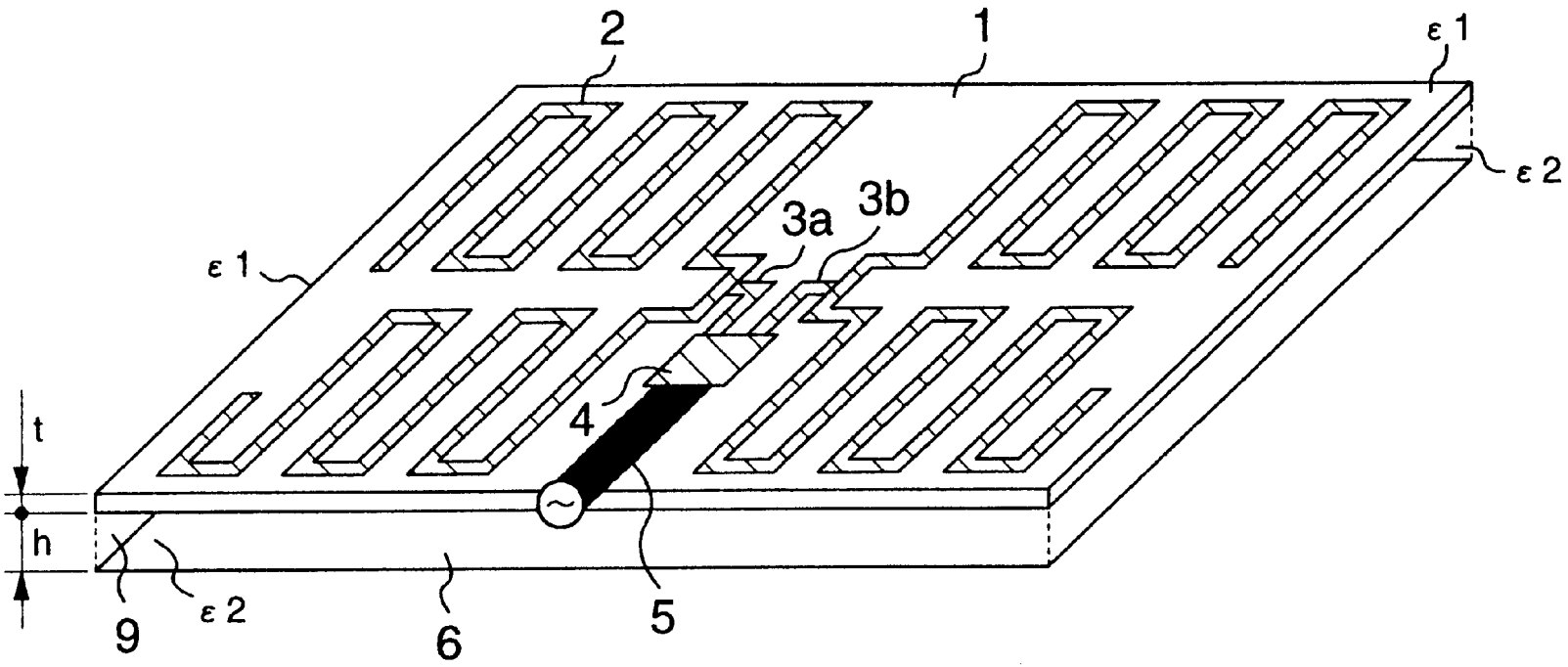
FIG. 1 is a perspective view of an antenna according to a first embodiment of the invention.
Figure 2:
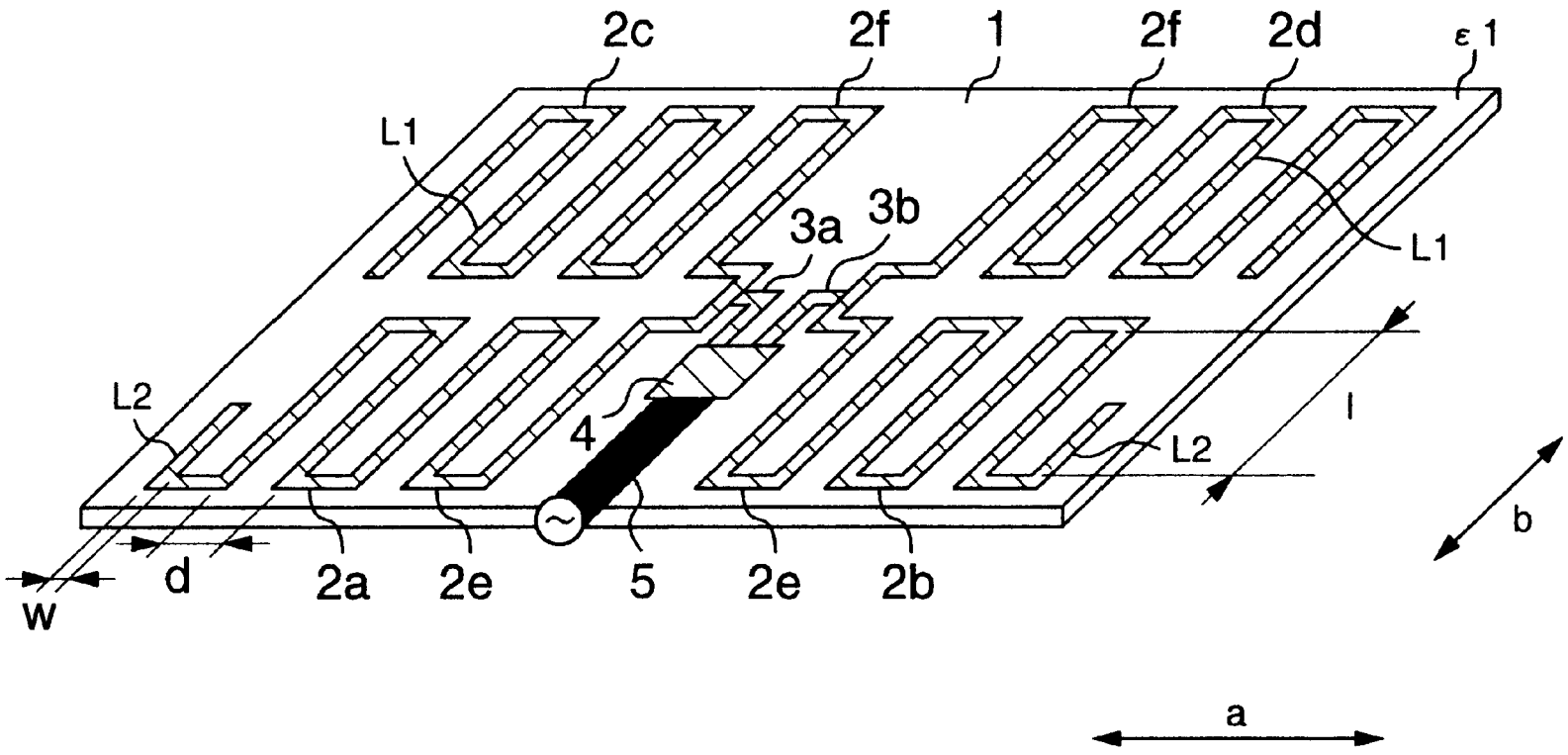
FIG. 2 is a perspective view of the antenna according to the first embodiment of the invention.
Figure 3:
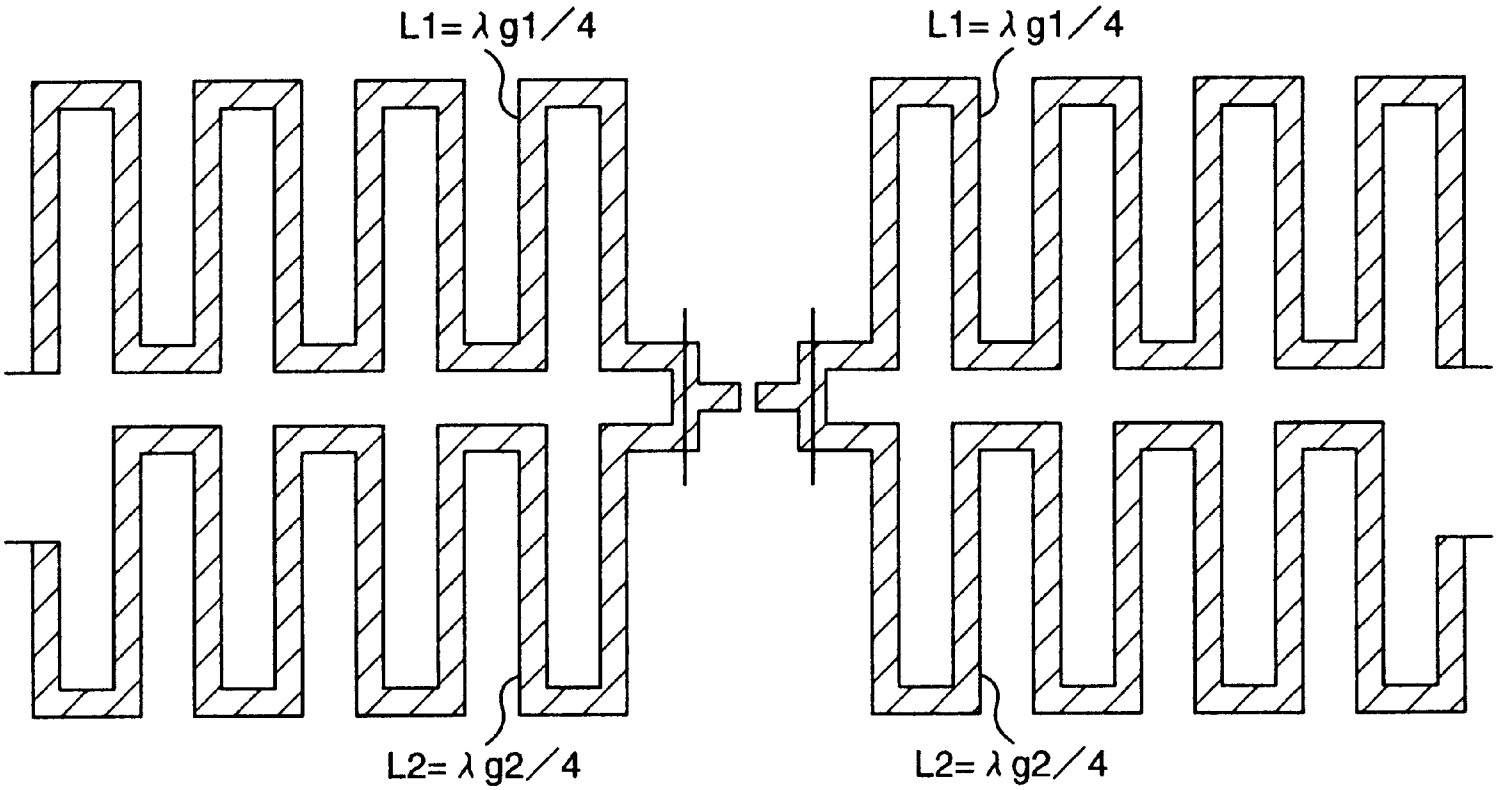
FIG. 3 is a plan view showing the construction of radiation elements formed on an antenna board in the first embodiment of the invention.

FIG. 1 is a perspective view of the first embodiment of the antenna of the invention, and FIG. 2 is a perspective view of the antenna of the first embodiment of the antenna of the invention. FIG. 3 is a plan view showing the construction of a radiation element formed on an antenna board in the first embodiment of the invention.

In FIG. 1, the antenna board 1 comprises of a dielectric material, and has a thickness t. The antenna board 1 usually comprises a printed circuit board or a PET film board. Various elements are formed and mounted on the antenna board 1, and these elements will be described below.

Radiation elements 2*a*, 2*b*, 2*c* and 2*d* are formed on one or both sides of the antenna board 1 by etching, photolithography, sputtering or other method. In this embodiment, in order that a plurality of wavelengths can be transmitted and received, one pair of radiation elements corresponds to one wavelength, and the radiation element pair 2*e*, constituted by the radiation elements 2*a* and 2*b* corresponds to a short wavelength (λg1), and the radiation element pair 2*f*, constituted by the radiation elements 2*c* and 2*d*, corresponds to a long wavelength (λg2).

The radiation elements 2*a* and 2*b* are formed substantially symmetrically in a longitudinal direction a of teh antenna board 1, and similarly the radiation elements 2*c* and 2*d* are formed substantially symmetrically in the longitudinal direction a of the antenna board 1. The radiation element pair 2*e* and the radiation element pair 2*f* are arranged generally symmetrically each other in a transverse direction b of the antenna board 1.

The radiation element 2*a* and the radiation element 2*c* are connected together in the vicinity of the center of the antenna board 1, and the radiation element 2*b* and the radiation element 2*d* are connected together in the vicinity of the center of the antenna board 1 being independent of the radiation elements 2*a* and 2*c*.

Each of the radiation elements 2*a*, 2*b*, 2*c* and 2*d* is formed by a meandering lind being bent regularly into such a meandering configuration wherein a line width w≈λ/100~λ/400, an element interval d≈λ/100~λ/200, and an element width l≈/10~λ/20. The radiation element 2*a* and the radiation element 2*b*, constituting the radiation element part 2*e*, have substantially the same line length, and also the radiation element 2*c* and the radiation element 2*d*, constituting the radiation element pair 2*f*, have substantially the same line length.

On the other hand, the radiation elements, constituting one of the radiation element pairs, are different in line length from the radiation elements constituting the other radiation element pair (for example, the radiation element 2*a* is different in line length from the radiation element 2*c*). More specifically, each of the radiation elements 2*a* and 2*b*, constituting the radiation element pair 2*e*, has the length L1 (L1≈(λg1)/4), and each of the radiation elements 2*c* and 2*d*, constituting the radiation element pair 2*f*, has the length L2 (L2≈(λg2)/4).

The radiation elements, corresponding to different wavelengths, are thus formed on the common board, and therefore as compared with the case where such radiation elements are formed on separate boards, the antenna construction can be simplified, and the productivity can be enhanced, besides the compact, thin design of the antenna can be achieved. Furthermore, since the different line lengths are provided, a plurality of wavelengths can be transmitted and received. Particularly, by setting the line length to about 25% of the corresponding wavelength, the optimum transmitting and receiving operation can be achieved for each corresponding wavelength, and also the polarization characteristics of the antenna can be enhanced.

The arrangement of the radiation elements 2*a* 2*b*, 2*c* and 2*d* are not limited to that of this embodiment. Various arrangements of radiation elements 2*a*, 2*b*, 2*c* and 2*d* are shown in FIGS. 14A to 26B. FIGS. 14A to 26B are plan views showing the constructions of the radiation elements formed on the antenna board of the invention.

Figure 14A:
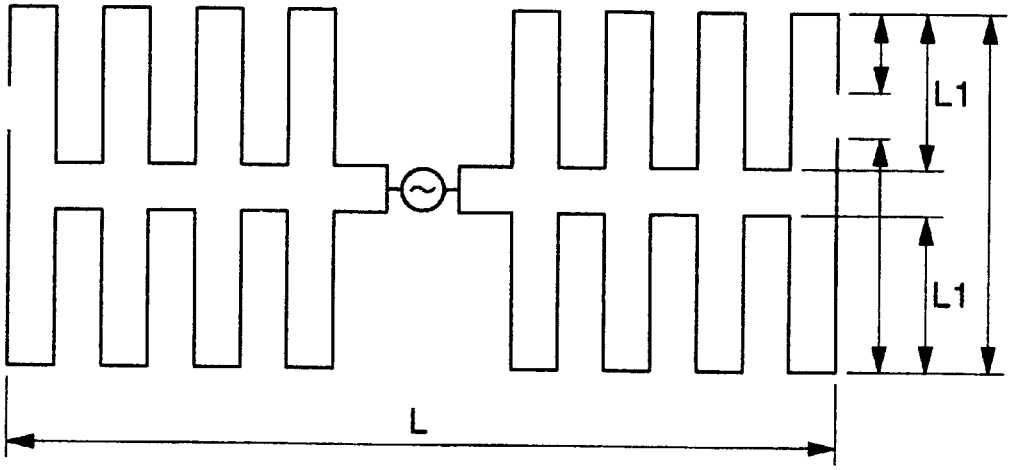
FIGS. 14A and 14B are plan views showing the construction of radiation elements formed in an antenna board in the invention.
Figure 15A:
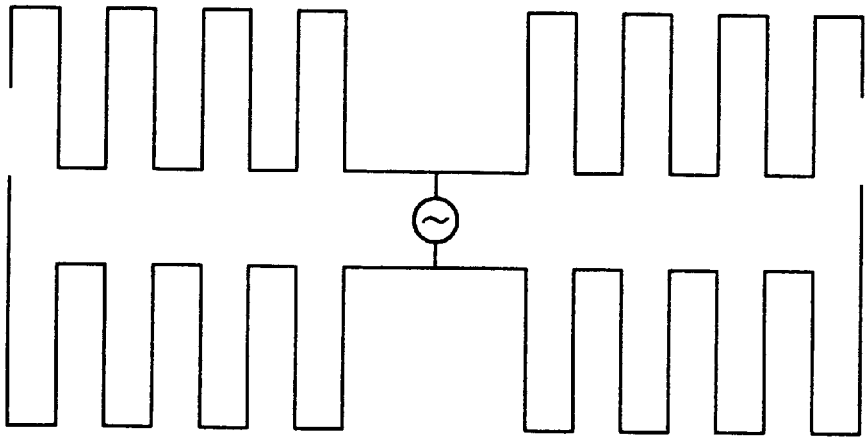
FIGS. 15A and 15B are plan views showing the construction of radiation elements formed in an antenna board in the invention.
Figure 15B:
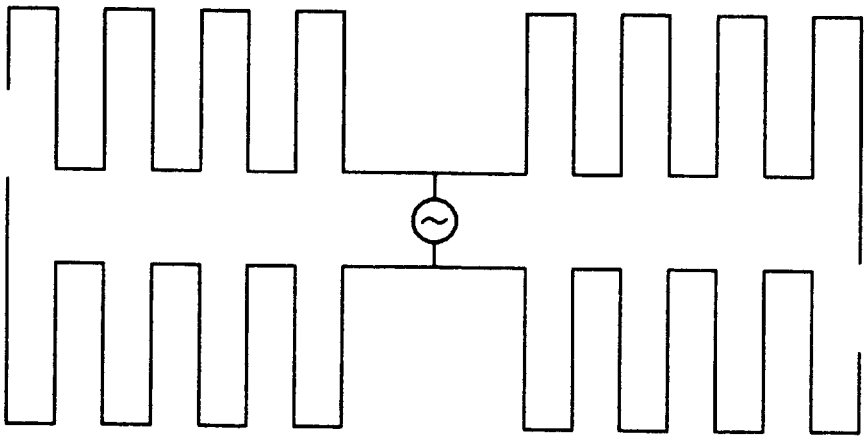

In the arrangements shown in FIGS. 14A and 15B, the antenna width is constant, and the element widths are the same. In the arrangement shown in FIG. 14A, the configuration of the radiation elements is symmetrical in a right-left direction, and is asymmetrical in a upward-downward direction, and power is fed right and left. Thus, the lengths of the elements are different at those ends which are the opposite sides of the feed portion, and merely with this construction, radio waves with different wavelengths can be transmitted and received, and therefore the design of the radiation elements is easy. Besides, since the power is fed in the right and left directions, the radiation elements with different lengths can be brought into the same power-fed condition, and therefore the difference in antenna characteristics due to the difference of the power-fed condition can be suppressed to a minimum.

Figure 14B:
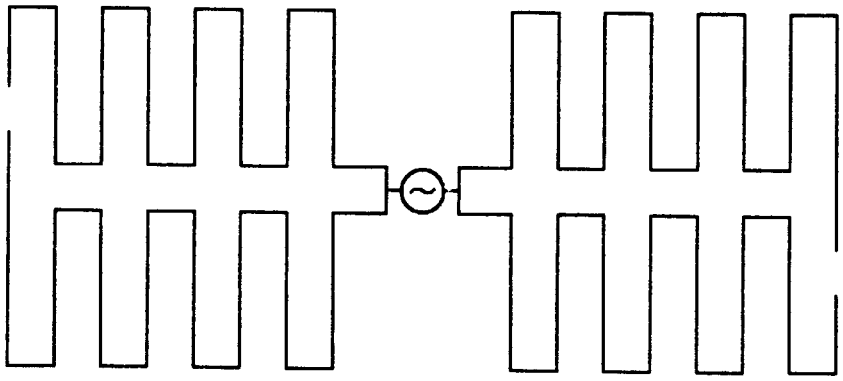

In the arrangement shown in FIG. 14B, the configuration of the radiation elements is symmetrical in the center, and is asymmetrical in an upward-downward direction, and power is fed right and left.

In the arrangement shown in FIG. 15A, the configuration of the radiation elements is symmetrical in a right-left direction, and is asymmetrical in an upward-downward direction, and power is fed upward and downward. In this case, the power is fed upward and downward, and therefore the radiation elements, which correspond to the same wavelength, can be brought into the same power-fed condition, and therefore a variation in antenna characteristics on the antenna board, which would be caused by the radiation elements corresponding to the same frequency, can be suppressed to a minimum.

In the arrangement shown in FIG. 15A, the configuration of the radiation elements is symmetrical in the center, and is asymmetrical in an upward-downward direction, and power is fed upward and downward. With this arrangement, the substantial element lengths can be increased, and therefore the width of the antenna device in its longitudinal direction can be shortened.

Figure 16A:
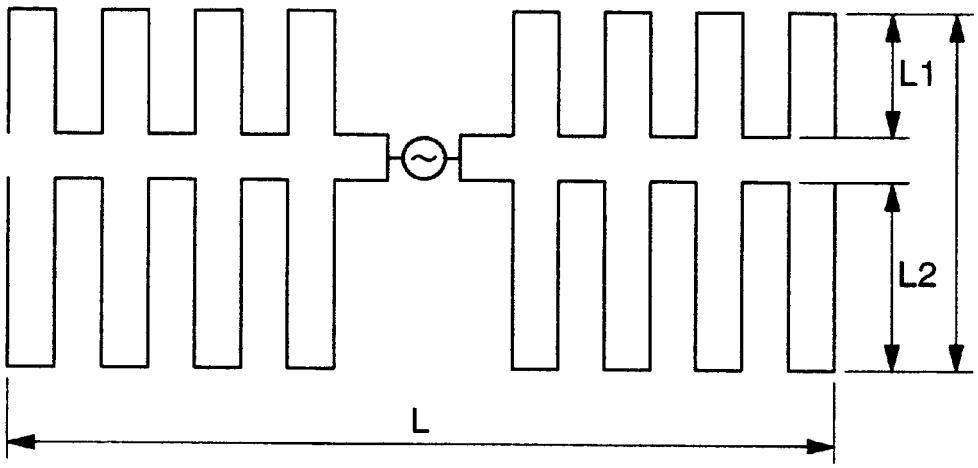
FIGS. 16A and 16B are plan views showing the construction of radiation elements formed in an antenna board in the invention.
Figure 16B:
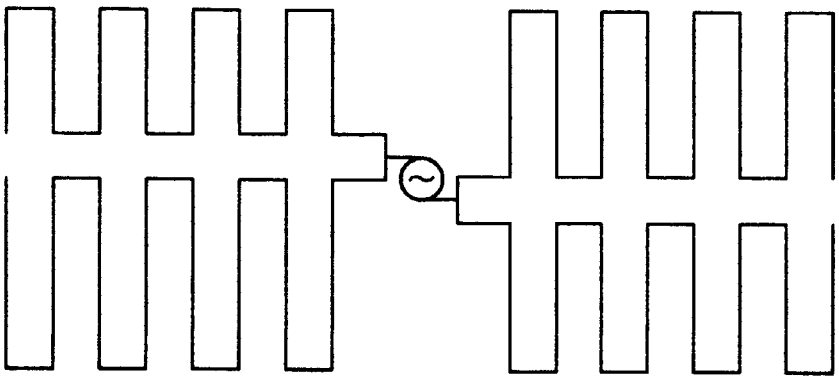
Figure 17A:
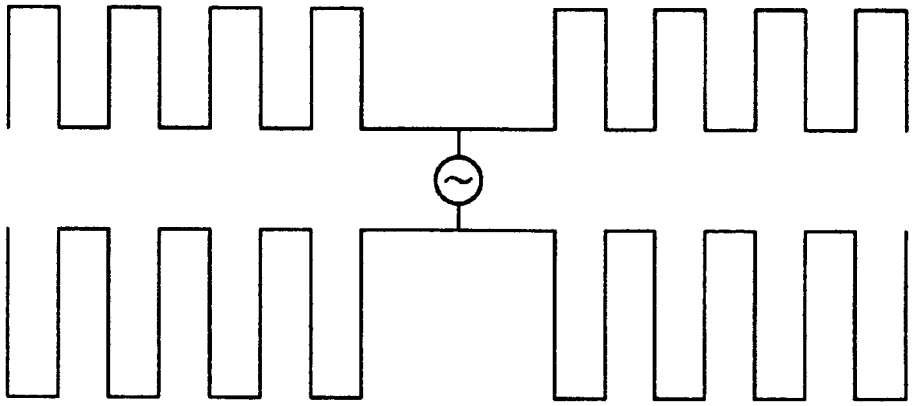
FIGS. 17A and 17B are plan views showing the construction of radiation elements formed in an antenna board In the invention.
Figure 17B:
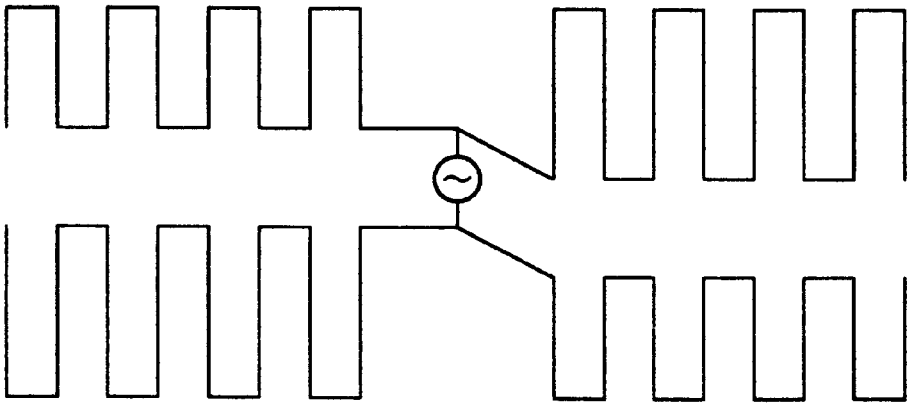

In the arrangements shown in FIGS. 16A, 16B, 17A and 17B, the antenna width is constant, and the element widths are different. In FIG. 16A, the configuration of the radiation elements is symmetrical in a right-left direction, and is asymmetrical in an upward-downward direction, and power is fed right and left. In FIG. 16B, the configuration of the radiation elements is symmetrical in the center, and is asymmetrical in an upward-downward direction, and power is fed right and left. In FIG. 17A, the configuration of the radiation elements is symmetrical in a right-left direction, and is asymmetrical in an upward-downward direction, and power is fed upward and downward. In FIG. 17B, the configuration of the radiation elements is symmetrical in the center, and is asymmetrical in an upward-downward direction, and power is fed upward and downward.

Figure 18A:
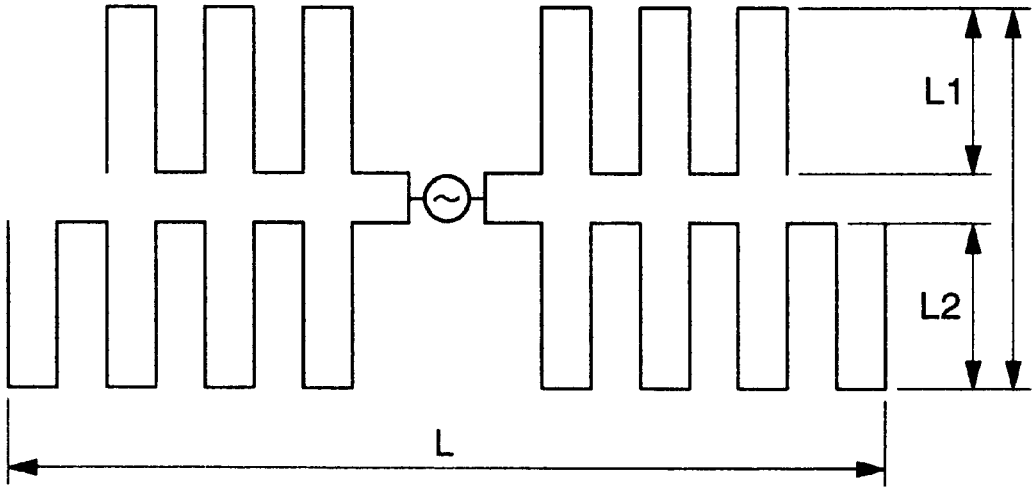
FIGS. 18A and 18B are plan views showing the construction of radiation elements formed in an antenna board in the invention.
Figure 18B:
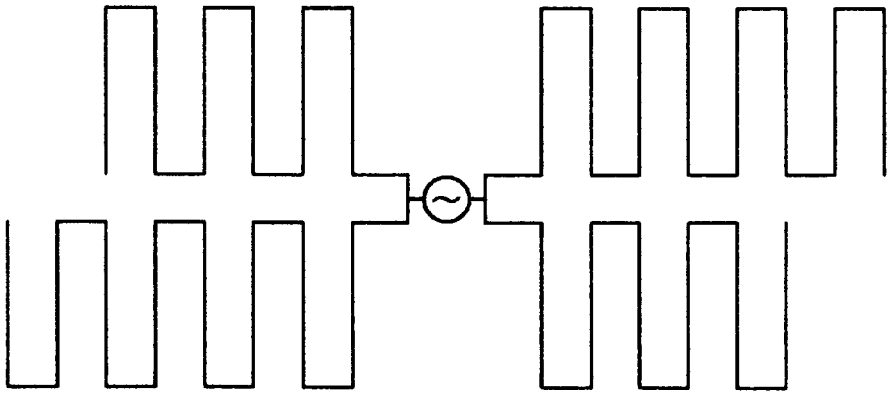
Figure 19A:
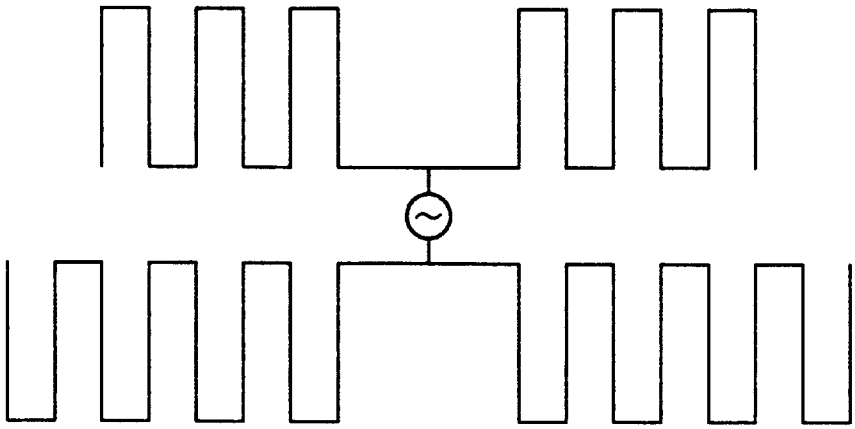
FIGS. 19A and 19B are plan views showing the construction of radiation elements formed in an antenna board in the invention.
Figure 19B:
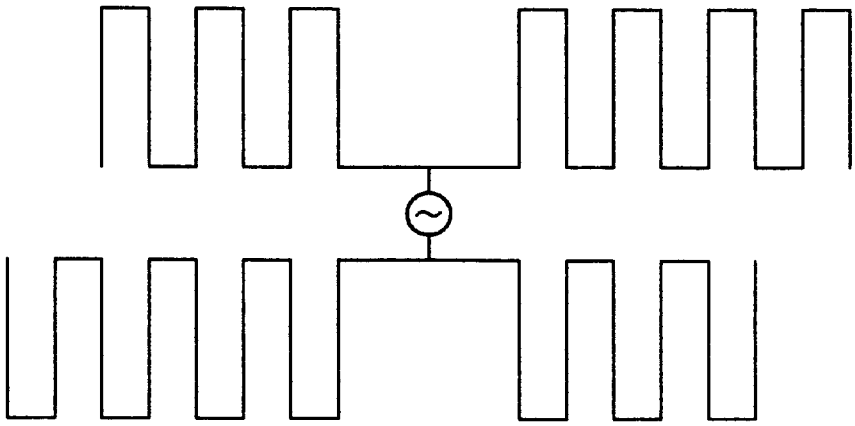
Figure 20A:
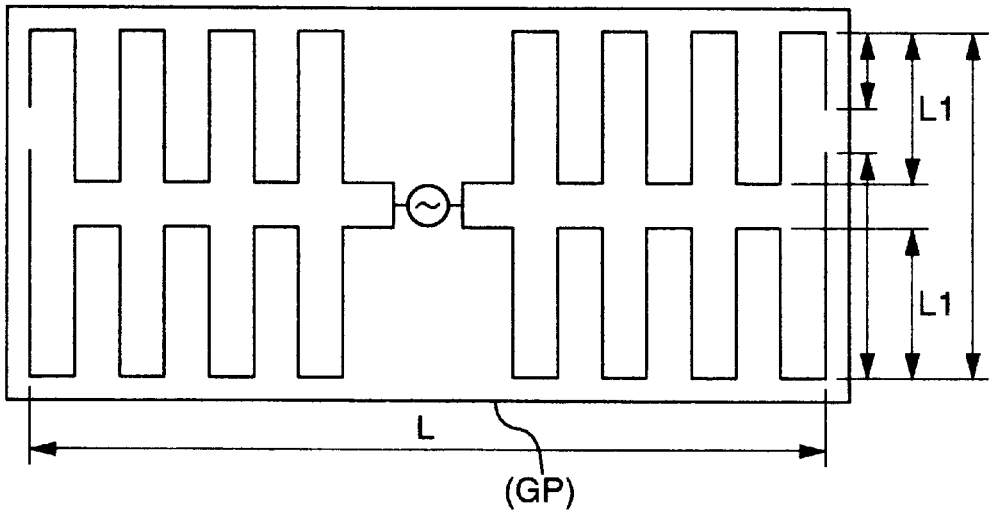
FIGS. 20A and 20B are plan views showing the construction of radiation elements formed in an antenna board in the invention.
Figure 20B:
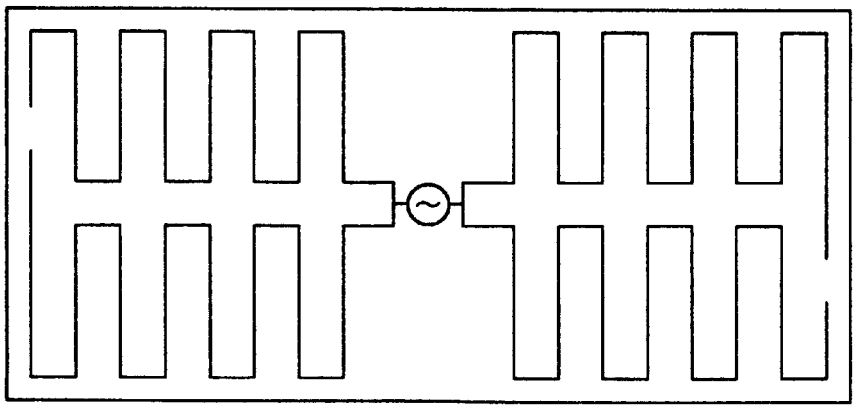
Figure 21A:
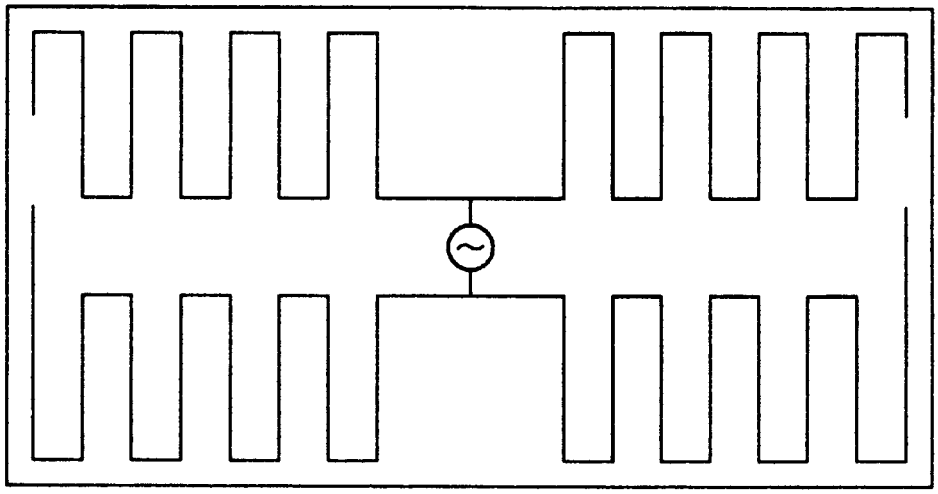
FIGS. 21A and 21B are plan views showing the construction of radiation elements formed in an antenna board in the invention.
Figure 21B:
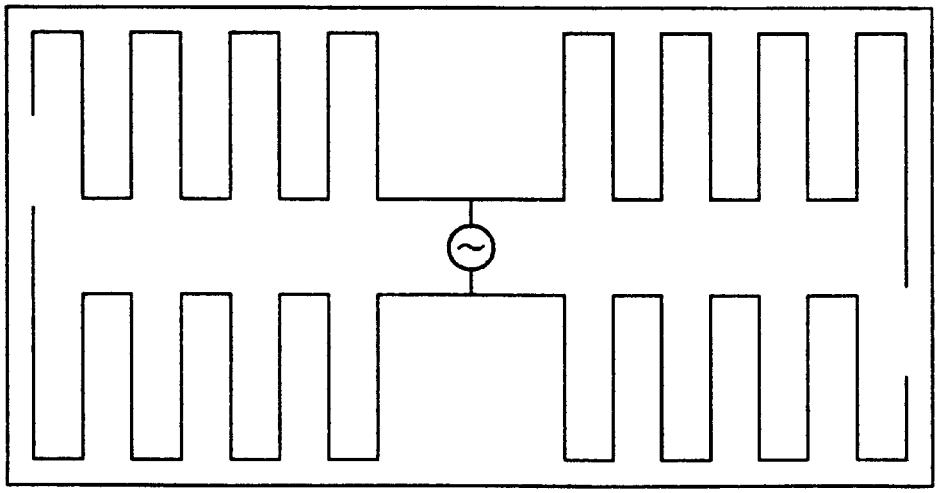
Figure 22A:
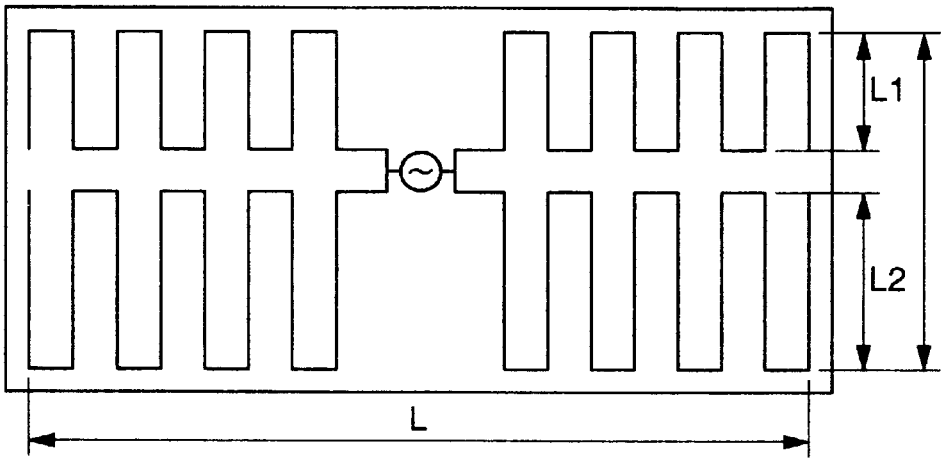
FIGS. 22A and 22B are plan views showing the construction of radiation elements formed in an antenna board in the invention.
Figure 22B:
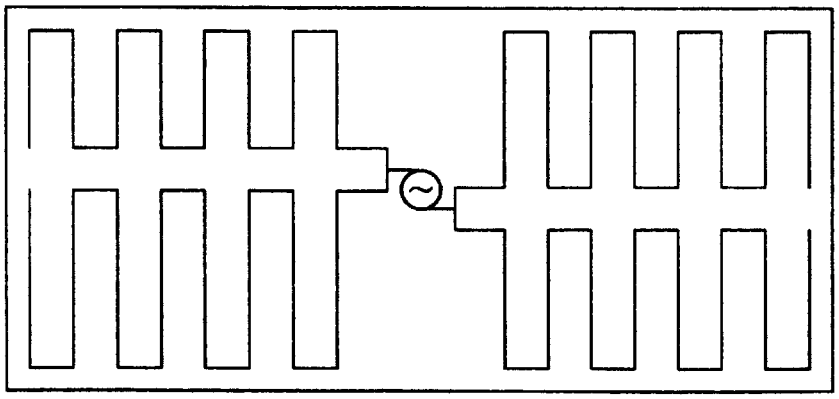
Figure 23A:
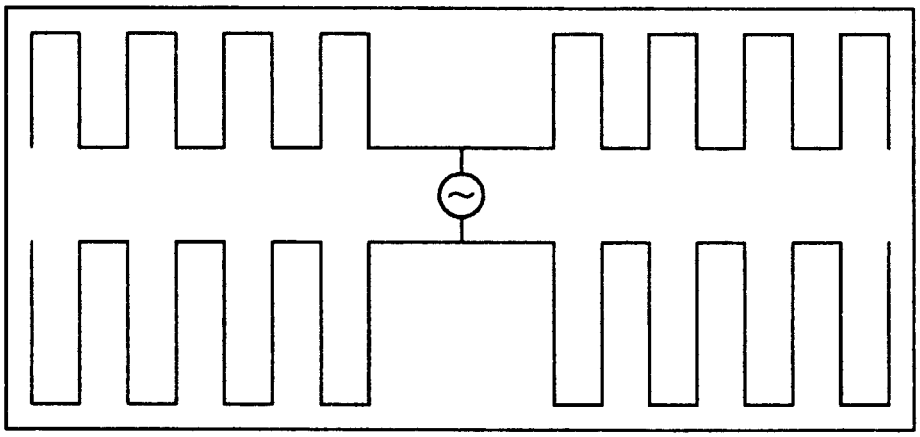
FIGS. 23A and 23B are plan views showing the construction of radiation elements formed in an antenna board in the invention.
Figure 23B:
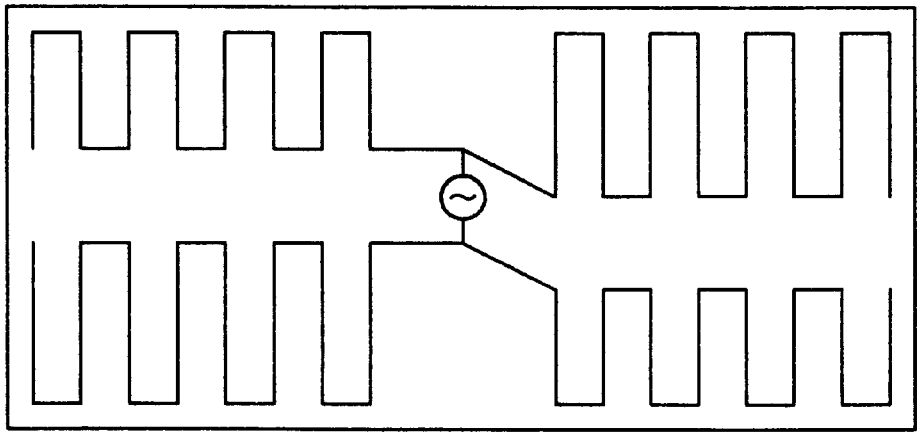
Figure 24A:
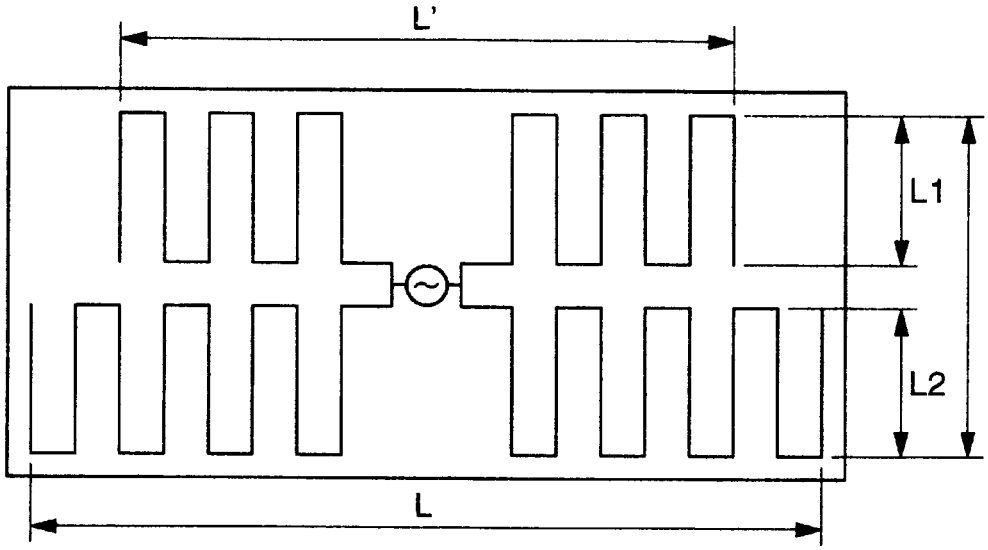
FIGS. 24A and 24B are plan views showing the construction of radiation elements formed in an antenna board in the invention.
Figure 24B:
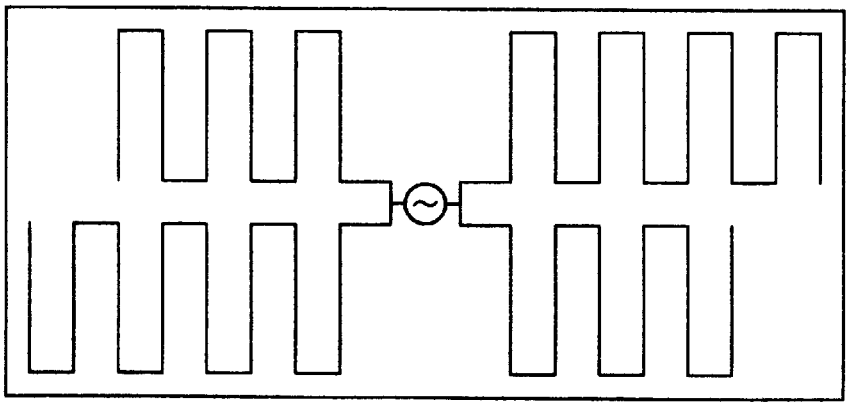
Figure 25A:
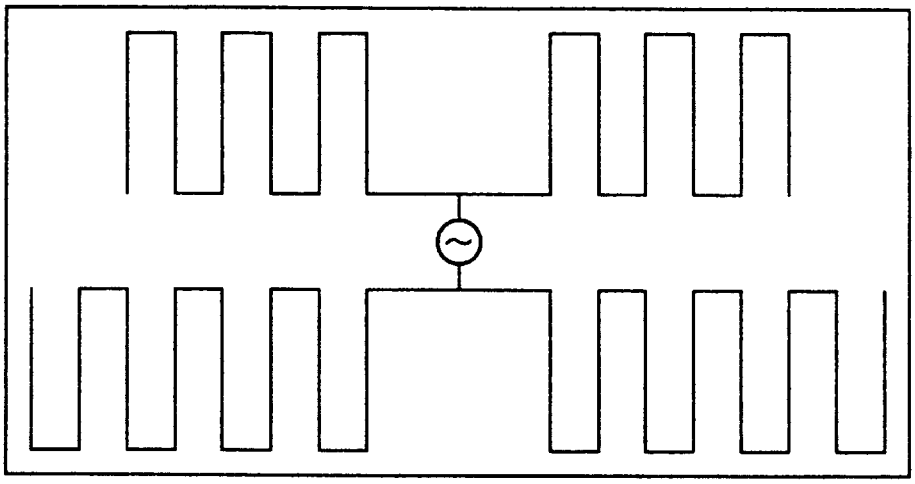
FIGS. 25A and 25B are plan views showing the construction of radiation elements formed in an antenna board in the invention.
Figure 25B:
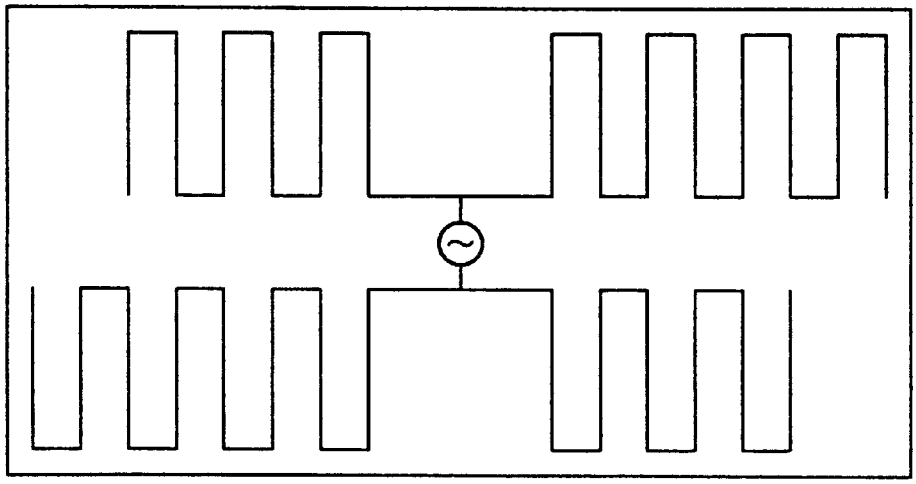

In the arrangements shown in FIGS. 18A, 18B, 19A and 19B, the antenna width is different, and the element widths are different. In FIG. 18A, the configuration of the radiation elements is symmetrical in a right-left direction, and is asymmetrical in an upward-downward direction, and power is fed right and left. In FIG. 18B, the configuration of the radiation elements is symmetrical in the center, and is asymmetrical in an upward-downward direction, and power is fed right and left. In FIG. 19A, the configuration of the radiation elements is symmetrical in a right-left direction, and is asymmetrical in an upward-downward direction, and power is fed upward and downward. In FIG. 19B, the configuration of the radiation elements is symmetrical in the center, and is asymmetrical in an upward-downward direction, and power is fed upward and downward.

The arrangements, shown in FIGS. 20A, 20B, 21A, and 21B, differ from those of FIGS. 14A to 15B in a ground plate being provided.

The arrangements, shown in FIGS. 22A, 22B, 23A and 23B, differ from those of FIGS. 16A to 17B in a ground plate being provided.

The arrangements, shown in FIGS. 24A, 24B, 25A and 25B, differ from those of FIGS. 18A and 19B in a ground plate being provided.

Figure 26A:
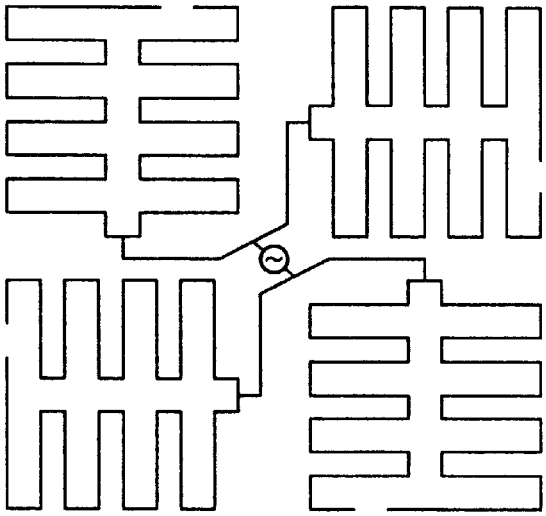
FIGS. 26A and 26B are plan view showing the construction of radiation elements formed in an antenna board in the invention.

In the arrangement shown in FIG. 26A, the antenna width is constant, and the element widths are the same, and four pairs of radiation elements (four radiation element pairs) are used, and these are arranged in a rotation symmetry manner to form an array. With this arrangement, the antenna device, capable of dealing with three or more frequencies, can be achieved with the simple construction. Also, the plurality of radiation element pairs can correspond to the same frequency, and therefore the antenna characteristics are enhanced, and if the directions of the radiation elements differ from one another, the antenna device having the wider receiving range can be realized.

Figure 26B:
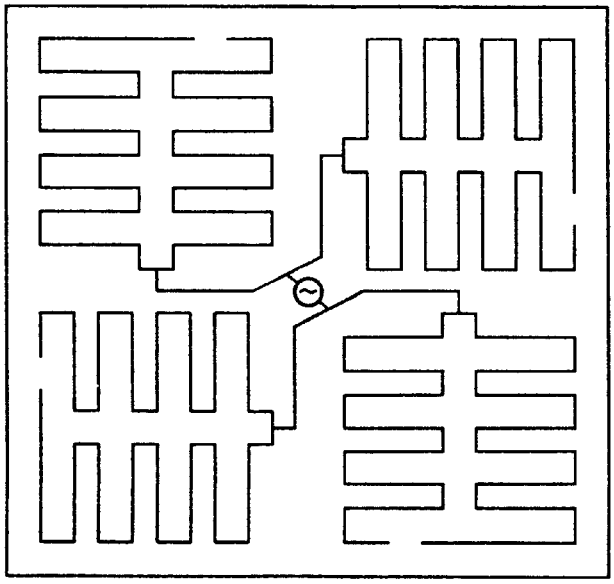

In the arrangement shown in FIG. 26B, the antenna width is constant, and the element widths are the same, and each radiation element pair is arranged in a rotation asymmetrical manner, and further a ground plate is provided.

The feed portion 3 serve to feed high-frequency power to the radiation elements 2, and is formed on that side (surface) of the antenna board 1, having the radiation elements formed thereon, or the back side thereof, the feed portion 3 being disposed in the vicinity of the center of the antenna board 1. In this embodiment, the feed portion 3*a* of the antenna board 1 is formed in the vicinity of the point of junction between the radiation elements 2*a* and 2*c* connected together, and feeds power to the radiation element s 2*a* and 2*c*. The feed portion 3*b* is formed in the vicinity of the point of junction between the radiation elements 2*b* and 2*d* connected together, and feeds power to the radiation elements 2*b* and 2*d*.

A matching circuit 4 and a transmission line 5 both serve to efficiently feed the predetermined high-frequency power to the feed portion 3. A coaxial cable or a micro-strip line can be use d as the transmission line 5.

The feed equipment is constituted by the transmission line 5. the matching circuit 4 and the feed portion 3.

Thus, the power is fed to the plurality of radiation elements 2*a*, 2*b*, 2*c* and 2*d* through the single feed equipment comprising the transmission line 5, the matching circuit 4 and the feed portion 3. With this construction, the power can be fed to the plurality of radiation elements 2 through the single feed equipment, and therefore the area of the antenna board 1, occupied by the feed equipment, can be reduced, and therefore the size of the antenna board 1 size can be reduced. Besides, since the power is fed both to the radiation element pair 2*e* and the radiation element pair 2*f* through the common feed equipment, the power can be fed to the radiation element pairs 2*e* and 2*f* under the same condition, and therefore the antenna of high reliability having excellent antenna characteristics can be provided both for the frequencies f1 and f2 to which the radiation element pairs 2*e* and 2*f* correspond, respectively.

Besides, since the single transmission line 5 connected to the antenna board 1 is provided, the construction of the antenna can be simplified compared with the case where one transmission line is provided for each radiation element pair, and therefore the productivity of the antenna can be enhanced. Furthermore, the number of lead-in through holes, extending to the exterior of the antenna, can be reduced, and therefore the intrusion of water and foreign substances through the lead-in holes can be suppressed to a minimum, and therefore the malfunction of the antenna due to these factors can be suppressed, and the antenna with high reliability can be achieved.

The radiation elements 2, the feed portion 3 and the matching circuit 4 may be formed on the same side (surface) of the antenna board 1, or the radiation elements 2 may be formed on one side of the antenna board 1 while the feed portion 3 and the matching circuit 4 may be formed on the other side thereof. If the radiation elements 2, the feed portion 3 and the matching circuit 4 are formed on the same side of the antenna board, the construction of the antenna board 1 can be simplified, and therefore the steps of processing and forming the antenna board 1 can be shortened, so that the productivity of the antenna board 1 can be enhanced. Besides, various circuits to be formed on the antenna board 1 can be simultaneously formed thereon, and therefore the productivity can be enhanced as well.

Furthermore, one radiation element pair 2*e* may be formed on one side of the antenna board while the other radiation element pair 2*f* may be formed on the other side thereof. With this construction, the distance between the radiation element pair 2*e* and the ground plate 6 and the distance between the radiation element pair 2*f* and the ground plate 6 are different from each other by an amount corresponding to the thickness t of the antenna board 1, and therefore in the case where the antenna characteristics required respectively for these radiation element pairs are different, the characteristics required respectively for the radiation element pairs can be optimized.

If the radiation elements 2, the feed portion 3 and the matching circuit 4 are formed on the same side of the antenna board 1, it is preferred that the radiation elements 2 and so on formed on the antenna board, should face the ground plate 6, that is, should be directed to the inner side of the antenna device. With this construction, the overall thickness of the antenna device can be reduced.

The ground plate 6 is made of a metal conductor such as aluminum, stainless steel or a plated copper.

A gap 9, with the height h, is formed between 5 the antenna board 1 and the ground plate 6. A dielectric plate may be inserted into the gap 9 over the entire area thereof, or several support members or means (not shown) may be provided in the gap 9 to support between them. If the gap 9 is formed by the use of the support means, the gap 9 is filled with the air.

The operation of the antenna of the above construction will now be described.

High-frequency power, fed through the transmission line 5. is supplied to the radiation elements 2*a*, 2*b*, 2*c* and 2*d* via the matching circuit 4. In this case, the dimensions of various portions of the radiation elements 2*a* and 2*b*, as well as the dimensions of various portions of the radiation elements 2*c* and 2*d*, are suitably selected, and by doing so, the radiation elements can radiate radio waves into the air with desired resonance frequency. Here, if the length of the radiation elements 2*a* and 2*b* is represented by L1, the length of the radiation elements 2*c* and 2*d* is represented by L2, the dielectric constant of the dielectric material, constituting the antenna board 1, is represented by $\in 1$, the thickness of the antenna board 1 is represented by t, the dielectric constant of the gap 9 between the antenna board I and the ground plate 6 is represented by $\in 2$, and the velocity of light is represented by C, the resonance frequencies f1 and f2 of the antenna are expressed by the following formulas:

$$f1 \approx C/2L1\sqrt{\in} \quad \text{(Formula 3)}$$

$$f2 \approx C/2L1\sqrt{\in} \quad \text{(Formula 4)}$$

Figure 11A:
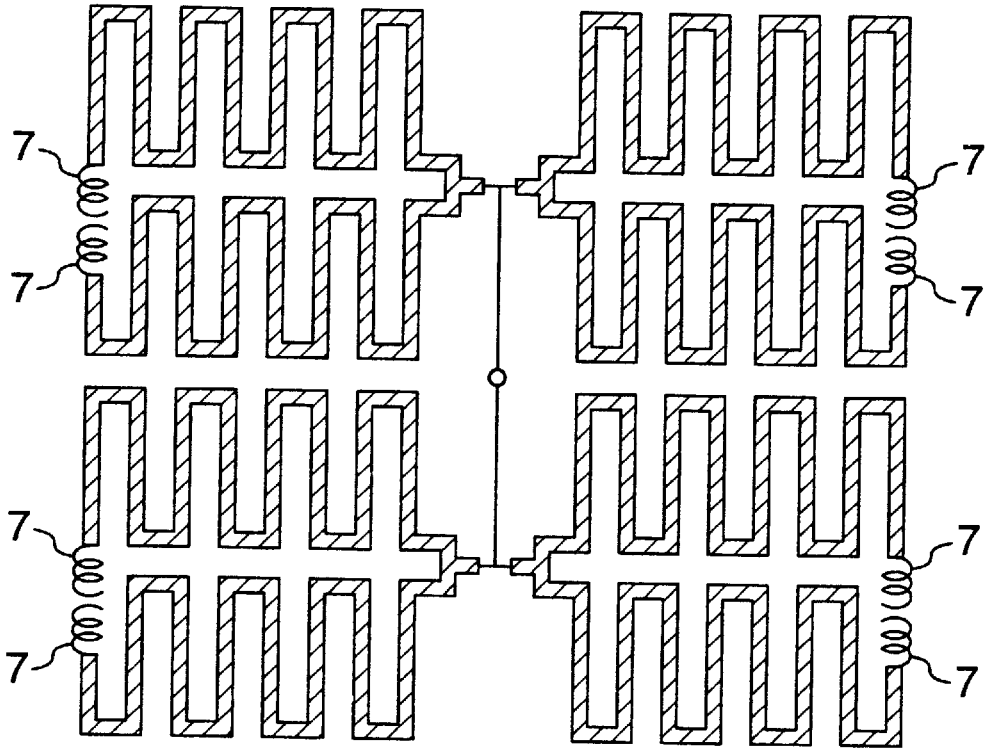
FIG. 11A is a plan view of an antenna and FIG. 11B is a graph showing resonance characteristics of an antenna according to the first embodiment of the invention.
Figure 11B:
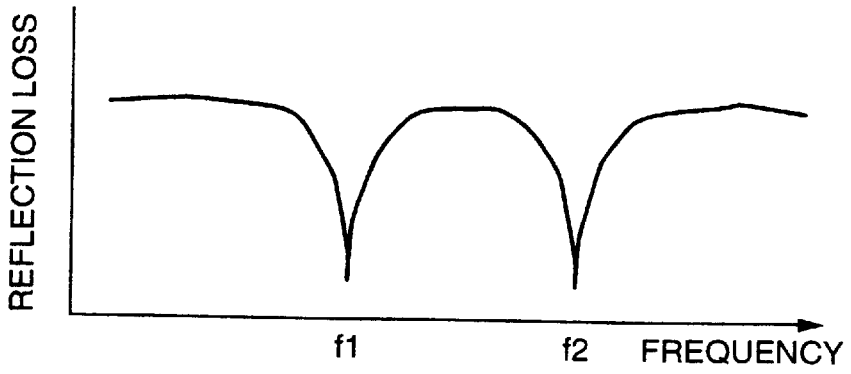

However, the following formula is established, and a plurality of resonance characteristics (two cycles in the case), as shown in FIGS. 11A and 11B, are obtained:

$$\in \approx (\in 1 \times \in 2(t+h))/(\in 1 \times h + \in 2 \times t) \quad (5)$$

FIGS. 11A and 11B are graphs showing the resonance characteristics of the antenna of the first embodiment of the invention.

Figure 12A:
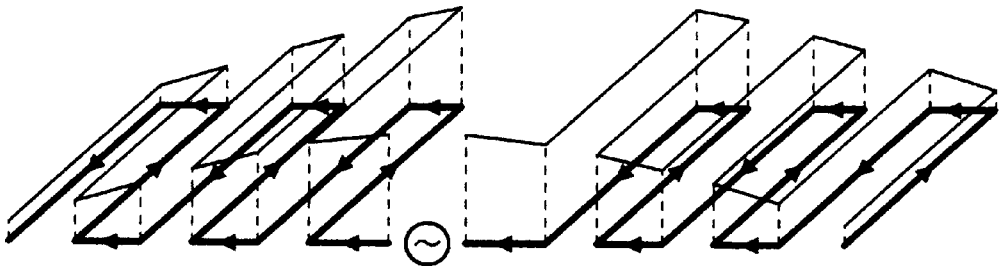
FIGS. 12A and 12B are graphs showing a current distribution in the antenna according to the first embodiment of the invention.
Figure 12B:
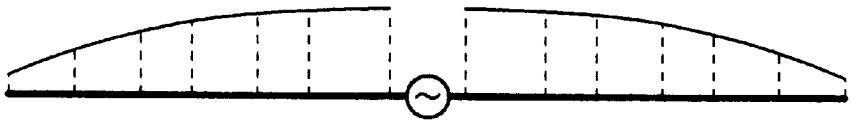
Figure 13A:
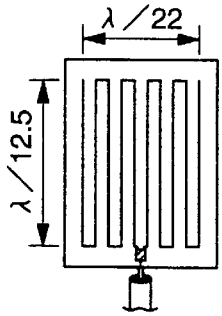
FIG. 13A is a plan view of the construction of a conventional antenna.
Figure 13B:
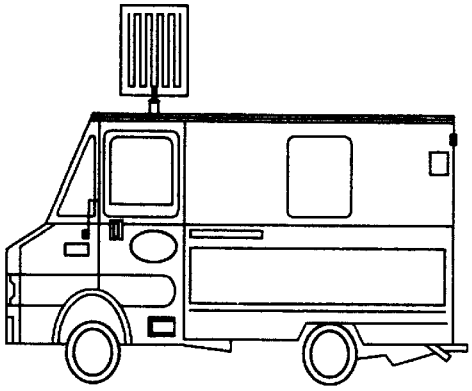
FIG. 13B is a view showing the installation of the conventional antenna.
Figure 13C:
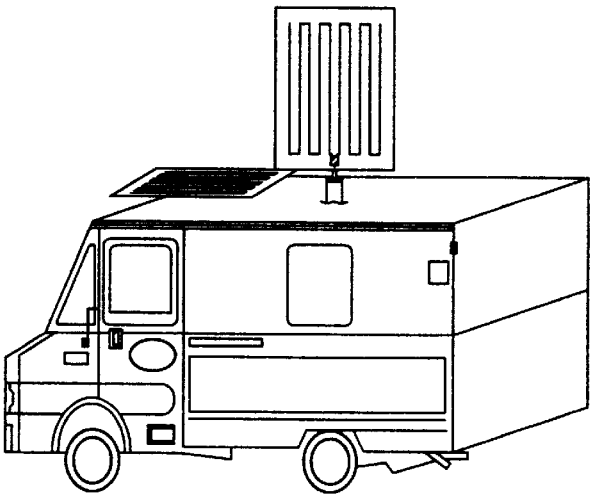
FIG. 13C is a view showing the installation of the conventional antenna.
Figure 13D:
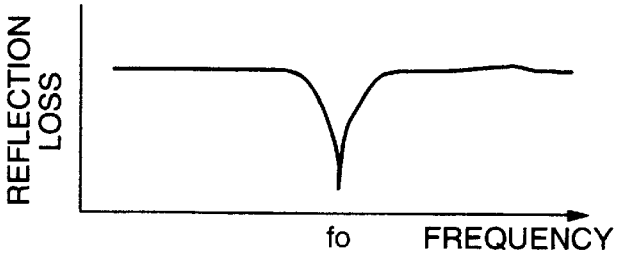
FIG. 13D is a graph showing resonance characteristics of the conventional antenna.

The current distribution in the antenna, obtained in this case, will be described with reference to FIGS. 12A and 12B. FIGS. 12A and 12B are views showing the current distribution in the antenna of the first embodiment of the invention. For the sake of simplicity, only the radiation element pair 2*f* is shown in FIGS. 12A and 12B.

As shown in the drawings, the element line length L1 of each of the radiation elements 2*c* and 2*d* is set to about ¼ length of a respective one of the two line wavelengths λg1 corresponding to the desired frequency f1, and by doing so, the current is distributed generally sinusoidally in the antenna in such a manner that the amplitude becomes maximum in the vicinity of the feed portion 3 at the desired frequency f1 while the amplitude becomes minimum at the distal end portions of the radiation elements 2*a* and 2*b*. As indicated by arrows (→) in the drawings, the two parallel lines, extending obliquely in an upward-downward direction on the sheet of the drawings, are opposite to each other with respect to the direction of flow of the current, and vertically-polarized waves due to this current cancel each other, and therefore the radiation of the vertically-polarized waves in a vertical direction on the drawing sheet can be almost eliminated. The two parallel lines, extending in the right-left direction on the sheet of the drawings, are the same with respect to the direction of flow of the current, and horizontally-polarized waves due to this current are radiated in a horizontal direction on the drawing sheet. Therefore, the antenna which has excellent polarization-identifying characteristics, and has a compact size can be provided.

Figure 5:
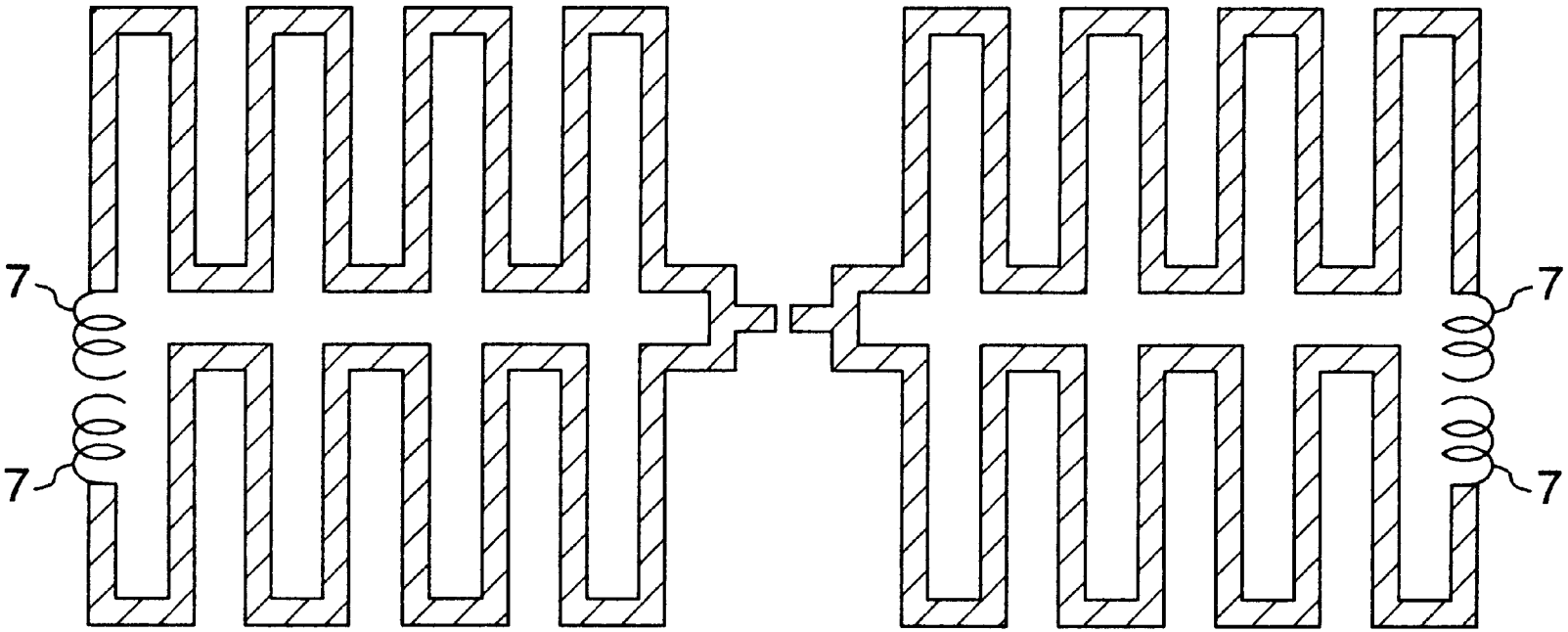
FIG. 5 is a plan view showing the construction of radiation elements formed on the antenna board in the first embodiment of the invention.

As shown in FIG. 5, an inductance device, comprising an air-core coil or a micro-strip line, can be provided at the distal end of each of the radiation elements 2. FIG. 5 is a plan view showing the construction of the radiation elements formed on the antenna board in the first embodiment of the invention.

With this construction, the effective length of the antenna is increased in an equivalent manner, and therefore the current amplitude (which contributes to radiation of the waves), flowing through the two parallel lines of the radiation element, extending in the main polarization direction, that is, in the right-left direction on the sheet is increased, and therefore the efficiency of the antenna is enhanced by the increased amplitude of the current.

Figure 6A:
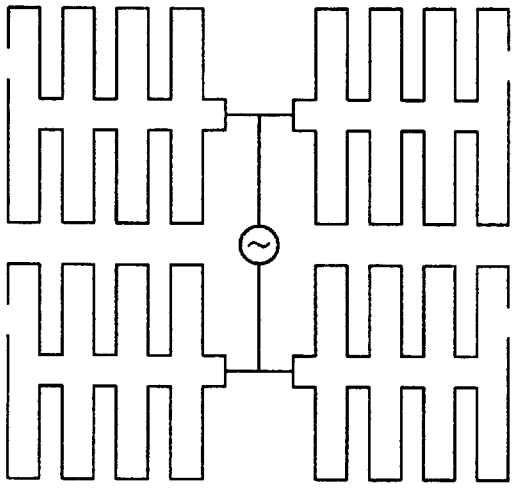
FIGS. 6A and 6B are plan views showing the construction of radiation elements formed on the antenna board in the first embodiment of the invention.
Figure 6B:
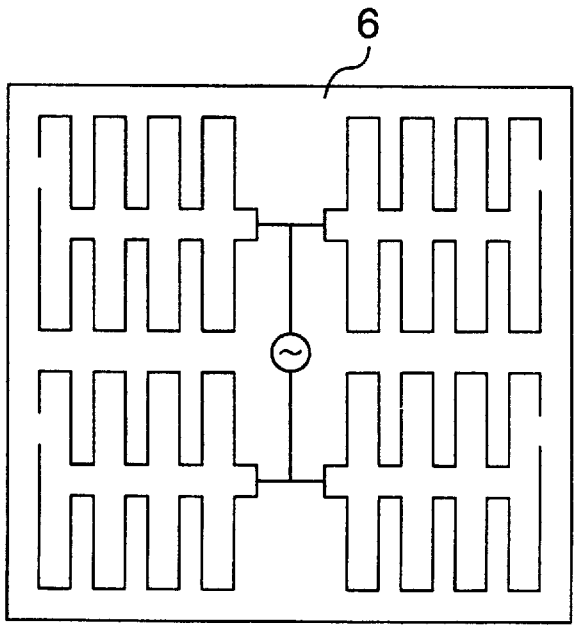

As shown in FIGS. 6A and 6B, a construction in which a plurality of antennas are formed on one antenna board, using a plurality of radiation element pairs 2*e*, a plurality of radiation element pairs 2*f* and one feed equipment is possible. FIGS. 6A and 6B are plan views showing the construction of the radiation elements formed on the antenna board in the first embodiment of the invention.

In this embodiment, the ground plate 6 is provided beneath the antenna. However, if there is no need to provide the ground plate 6 in the vicinity of the antenna board 1, the antenna can be formed by the antenna board 1, having the radiation elements 2, the feed portion 3 and the matching circuit 4 formed thereon, and the transmission line 5, as shown in FIG. 2. In this case, the antenna can be further reduced in thickness, and can be further simplified in construction. Therefore, the antenna can be installed in a narrow space, and the productivity of the antenna device can be enhanced.

Second Embodiment

Figure 4:
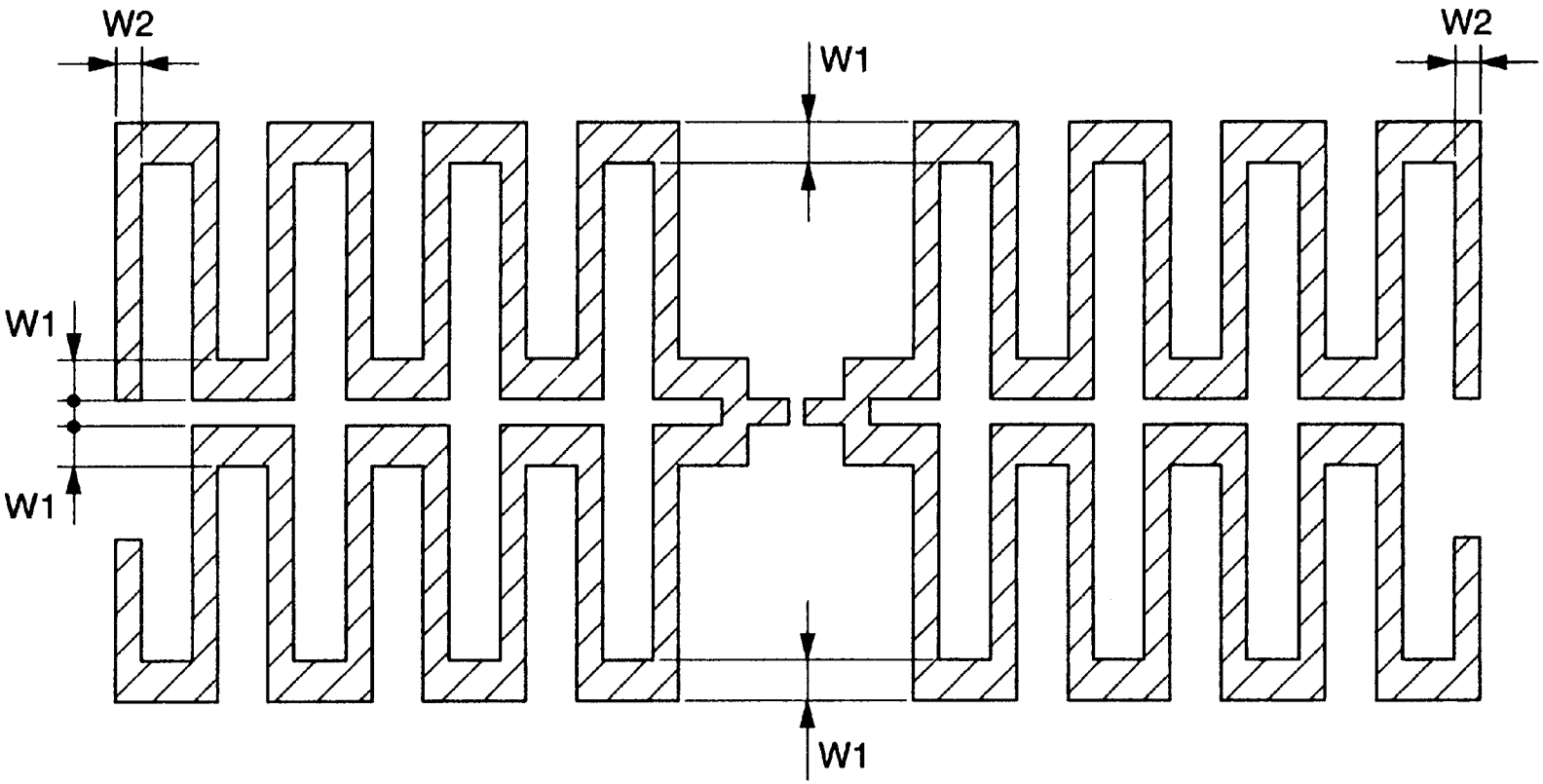
FIG. 4 is a plan view showing the construction of radiation elements formed on an antenna board in a second embodiment of the invention.

A further preferred arrangement of radiation elements 2 will be described. This construction is the same construction as the first embodiment except for the arrangement of the radiation elements. FIG. 4 is a plan view showing the construction of the radiation elements formed on an antenna board in the second embodiment of the invention. As shown in FIG. 4, in this embodiment, the radiation element width W1 of two parallel lines of radiation elements 2, extending in a main polarization direction, that is, in a right-left direction on the drawing sheet, is larger than the radiation element width W2 of those portions of the radiation elements extending in a polarization direction perpendicular to the main polarization direction, that is, in a vertical direction on the drawing sheet. Generally, when a transmission line, such as a micro-strip line, is provided on an upper surface of a ground plate, the larger the line width of the radiation element 2 is, the larger the amount of radio waves radiated from this transmission line, is, if the distance h between the ground plate 6 and the radiation element 2 is constant. In contrast, the smaller the line width of the radiation element 2 is, the smaller the amount of the radiated radio waves is. Therefore, the radiation element width W1 of the two parallel lines, extending in the main polarization direction, that is, in the right-left direction on the drawing sheet, is increased, and the radiation line width W2 of those portions of the radiation elements, extending in the polarization direction perpendicular to the main polarization direction, that is, in the vertical direction on the drawing sheet, is made smaller than the width W1. By doing so, the radiation of the horizontally-polarized waves in the direction, parallel to the drawing sheet, can be further increased while more efficiently suppressing the radiation of the vertically-polarized waves (which cancel each other) in the vertical direction on the drawing sheet. Therefore, the gain of the necessary horizontally-polarized waves can be increased while reducing a radiation loss due to the unnecessary vertically-polarized waves, thereby greatly enhancing the efficiency of the antenna can be realized.

Third Embodiment

Figure 7:
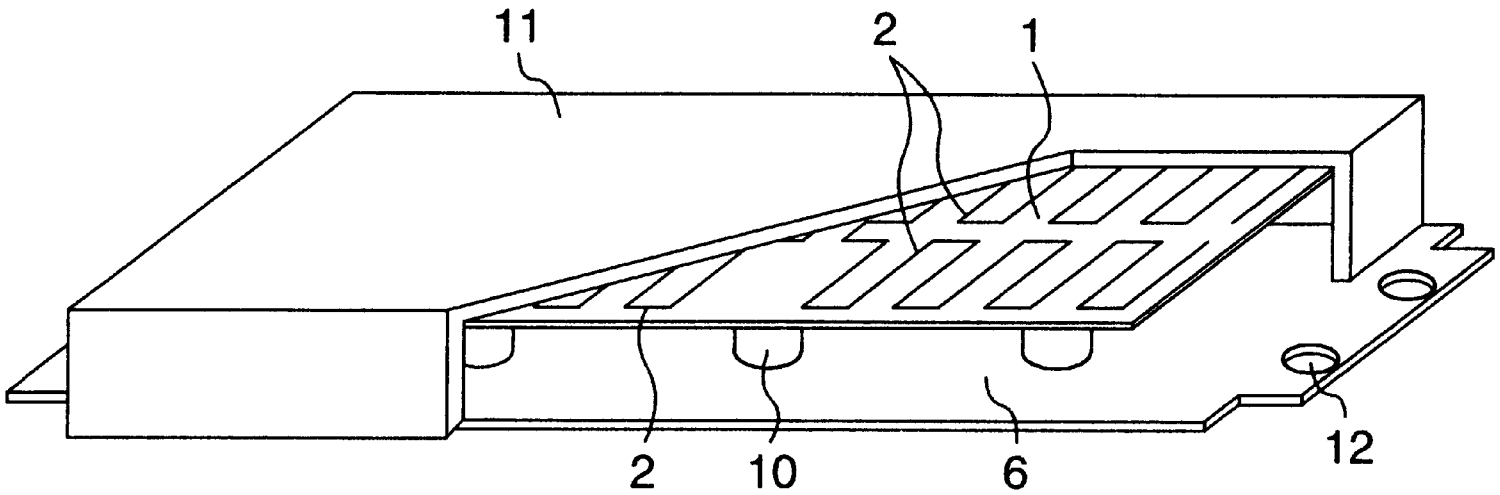
FIG. 7 is a perspective view showing the construction of an antenna according to a third embodiment of the invention.

Next, a third embodiment of the present invention will be described with reference to the drawings. FIG. 7 is a perspective view showing the construction of an antenna of the third embodiment of the invention, and those members identical to those of the first embodiment will be designated by identical reference numbers, respectively.

In the antenna of this embodiment, an antenna board 1, on which radiation elements 2, a feed portion 3 and a matching circuit 4 are formed, and a ground plate 6 are basically similar in construction to those of the first embodiment, respectively.

Spacers 10 are made of an elastic material such as rubber or a resin, and are interposed, as support ,members, between the antenna board 1 and the ground plate 6 to keep the gap between the antenna board 1 and the ground plate 6 accurately to a height h. Preferably, the spacers 10 are mounted respectively on those portions of the antenna board 1 on which the radiation elements 2 are not formed. With this arrangement, a change in dielectric constant of the gap between the ground plate 6 and the antenna board 1, which affects the antenna characteristics, can be kept to the minimum.

Although not shown in the drawing, in order that the mounting positions can be easily recognized, mounting recesses are preferably formed in at least one of the ground plate 6 and the antenna board 1, and the spacers 10 are fitted in these recesses, respectively. With this construction, the spacers 10, when mounted, will not be disposed out of position, and therefore a change of the antenna characteristics, resulting from the mounting of the spacer 10 on that portion of the antenna board 1 on which the radiation element 2 is formed, hardly occurs. As a result, the antenna of high reliability can be achieved.

An arrangement may be used in which projections are formed on at least one of the ground plate 6 and the antenna board 1 while recesses for fitting respectively on these projections are formed in the spacers 10, respectively. Alternatively, an arrangement may be used in which through holes are formed through at least one of the ground plate 6 and the antenna board 1, and the spacers 10 are fixed by screws passing respectively through these through holes.

In this embodiment, in addition to the spacers 10 provided only between the antenna board 1 and the ground plate 6, spacers may be further provided between the ground plate 6 and a radome 11. In this case, preferably, the spacers, provided between the antenna board 1 and the ground plate 6, are larger in height than the spacers provided between the ground plate 6 and the radome 11, and with this construction the antenna board 1 is spaced farther from the ground plate 6, and this enhances the antenna characteristics.

If the additional spacers are not used, it is preferred for the same reason that the antenna board 1 should be disposed closer to the radome 11 than to the ground plate 6.

Preferably, the elasticity of the spacer is different depending on whether the spacer is held in contact with the obverse surface or the reverse surface of the antenna board 1. More specifically, the spacer, held in contact with that surface of the antenna board 1 having the radiation elements 2 formed thereon, has higher elasticity, and the spacer, held in contact with that surface of the antenna board 1 having no radiation element 2 formed thereon, has lower elasticity. With this construction, when the antenna board 1 is displaced out of position by vibrations or the like, the possibility of damaging the radiation elements 2 by the spacers is lowered.

In the case where the antenna board 1 is held in direct contact with the radome 11, it is preferred for the same reason that that surface of the antenna board 1, having the radiation elements 2 formed thereon, should face the ground plate 6.

The radome 11 is provided to cover the antenna board 1 having various circuits and so on formed thereon, and preferably the radome 11 is made of a material (e.g. a resin) having weather resistance. The antenna board 1, the spacers 10 and so on are covered with the radome 11 and the ground plate 6, and the radome 11 and the ground plate 6 are bonded together by a bonding material, or fixed together by bolts or the like. Preferably, the boundary portion between the radome 11 and the ground plate 6 is sealed against water or moisture by a waterproof seal member or an O-ring, and by doing so, the intrusion of water into the inside of the antenna is prevented, thereby preventing the degradation of the antenna characteristics and the malfunction of the antenna.

More preferably, the inside of the antenna is completely sealed, and inert gas, such as dry air or nitrogen gas, is sealed in the inside of the antenna. With this construction, dew condensation, developing within the antenna which may be used in a weather-beaten condition, can be suppressed, and therefore the degradation of the antenna characteristics and the -malfunction of the antenna due to such condensation can be prevented.

Mounting holes 12 are formed through end portions of the ground plate 6, and the ground plate 6 of the antenna can be mounted directly on a box-like metal body of a vehicle or a container through the mounting holes 12. With this construction, the antenna device of this embodiment can be mounted or installed directly on the mounting body or structure, with the ground plate 6 serving as the bottom surface. Therefore, the height of the antenna device from the installation surface is smaller as compared with the case where the antenna device is installed with using an antenna-mounting member.

In this embodiment, although the mounting holes are arranged only in the transverse direction of the antenna, the mounting holes may be formed and arranged only in the longitudinal direction, or may be formed and arranged in the transverse and longitudinal directions in surrounding of the antenna device.

If the ground plate 6 of the antenna and the box-like metal box (i.e., the mounting object) are bonded together by an electrically-conductive bonding material, the mounting holes 12 do not need to be provided.

Next, the mounting of the antenna board 1 will a be described. In this embodiment, the antenna board 1 is pressed against the inner surface of the radome 11 by the spacers 10, provided between the antenna board 1 and the ground plate 6, and therefore is fixed. In this case, the spacers 10 have a certain degree of elasticity, and the inner surface of the radome 11 is disposed substantially parallel to the ground plate 6 after the assembling of the antenna is completed. The antenna board 1 and the spacers 10 are beforehand located at their respective predetermined positions relative to the ground plate 6, and in this condition the radome 11 is mounted on the ground plate 6. By doing so, the mounting and fixing of the spacers 10 relative to the antenna board 1 and the ground plate 6, as well as the fixing of the antenna board 1 relative to the ground plate 6, can be effected, and therefore the antenna of high productivity can be provided in which the number of the antenna-assembling and mounting steps can be reduced. Since the antenna board 1 is pressed against the radome 11, the antenna board 1 can have the good flatness with the simple construction, and therefore the distance between the antenna board 1 and the ground plate 6, which particularly exerts a great influence on the antenna characteristics, can be made substantially constant. Therefore, there can be achieved the antenna which has the excellent antenna characteristics and productivity, and can deal with a plurality of frequencies.

For fixing the radome 11 and the ground plate 6 together, mounting holes are formed in those portions of the radome 11 aligned respectively with the mounting holes 12, and common mounting members are used. Alternatively, mounting holes are formed in the radome 11, and mounting portions are formed on those portions of the ground plate 6 aligned respectively with these mounting holes in the radome 11, and the fixing is effected using fixing members such as screws. In the case where the mounting portions are formed on the ground plate 6, it is preferred that projections or convex portions, projecting toward the outer surface of the antenna, should not be formed. With this construction, the height of the antenna device can be lowered, and also the flatness of the ground plate 6, serving as the mounting surface for mounting on the antenna-mounting object, can be secured. Therefore, there can be achieved the antenna device in which the mounting operation is easy, and which has the good stability.

The installation of the antenna of the above construction on the mounting object (particularly on a vehicle (truck)) will be described with reference to the drawings.

Figure 8:
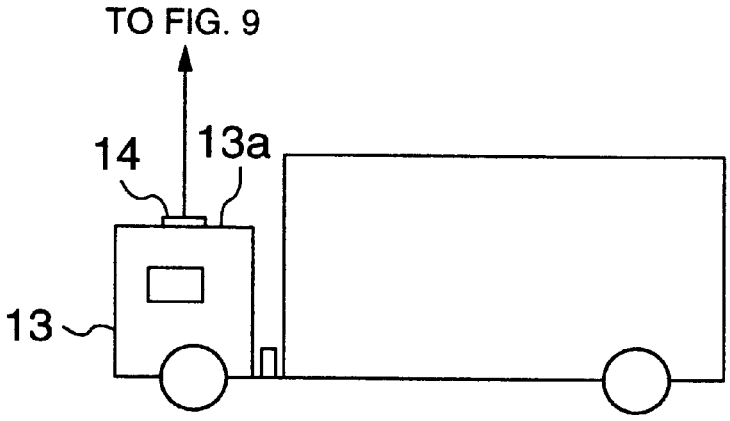
FIG. 8 is a view showing the installation of the antenna on a car in the third embodiment of the invention.
Figure 9:
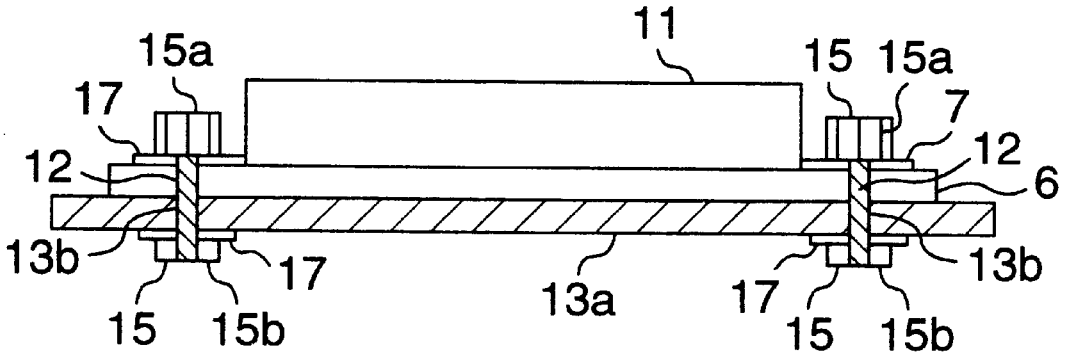
FIG. 9 is an enlarged view showing an antenna-mounting portion in the third embodiment.

FIG. 8 is a side-elevational view showing the installation of the antenna of the third embodiment on the vehicle, and FIG. 9 is an enlarged view showing an antenna-mounting portion in the third embodiment of the invention.

Reference number 13 denotes a vehicle body (mounting object), and the above-mentioned antenna 14 is installed on a box-like metal body 13*a* of the upper part of the vehicle body 13. More specifically, through holes 13*b* are formed respectively through the box-like metal body 13*a* aligned respectively with the mounting holes 12 in the antenna 14, and a bolt 15*a* of fixing means 15 is passed through the aligned mounting hole 12 and through hole 13, and the bolt is tightened using a nut 15*b* threaded on the distal end of the bolt, thus mounting the antenna 14 on the vehicle body 13.

In this case, preferably, the ground plate 6 of the antenna 14 is held in direct contact with the box-like metal body 13*a* of the car body 13. This will be described below. In many cases, the antenna 14 of this embodiment is mounted on the mounting surface of a box-like metal body of a car or a container (mounting object) in parallel relation thereto. Generally, when an antenna is mounted in close proximity to a box-like metal body (mounting object) of a car or a container, the characteristics of the antenna are often adversely affected even if the antenna is beforehand so adjusted that the antenna characteristics become optimum at a predetermined frequency. The reason is that the antenna impedance is influenced by the box-like metal body, on which the antenna is mounted, and is decreased, so that the loss increases because of the mismatching with an impedance of a feeder.

In order to prevent such antenna characteristics change, the ground plate 6 of the antenna 14 is exposed, and is adapted to be in direct contact with the box-like metal body 13*a* of the vehicle body 13. With this construction, the ground plate 6 of the antenna 14 and the box-like metal body 13*a* can be kept at the same potential. and therefore a change of the antenna characteristics due to the influence of the box-like metal body 13*a* can be almost eliminated. The ground plate 6 of the antenna 14 and the box-like metal body 13*a* need only to be held in electrical contact with each other, and therefore the ground plate 6 and the box-like metal body 13*a* may be bonded together by an electrically conductive bonding material, instead of using the fixing means 15. In this case, the installation of the antenna 14 on the vehicle body 13 can be effected easily, besides here is no need to provide the mounting holes 12 in the round plate 6. Therefore, the construction of the round plate 6 can be simplified, and the antenna can be achieved which has high productivity and a low-cost design, and can be used easily.

Although not shown in the drawing, a cushioning member may be provided between the antenna 14 and the vehicle body 13. In this case, an impact due to vibrations, developing during the movement of the car or the container (on which the antenna 14 is installed), is not reached the antenna 14 directly, and therefore the antenna 14 is not damaged by such impact, then the reliability of the antenna 14 can be enhanced.

Preferably, the fixing means 15 is made of metal in order that the ground plate 6 and the box-like metal body 13*a* can be positively held in electrical contact with each other. This is effective particularly where the cushioning member is interposed between the antenna 14 and the vehicle body 13 and where the antenna 14 and the vehicle body 13 are not held in direct contact with each other.

Reference number 16 denotes fixing means-assisting member. Preferably, the fixing means-assisting member 16 has a ring-shape, and is made of a material (e.g. rubber) which has a waterproof property so as to prevent the intrusion of water into the inside of the mounting object through the fixing means 15, and has a certain degree of elasticity. Such fixing means-assisting member 16 effectively suppresses the intrusion of water. Specifically, a washer, made of rubber, can be used as the fixing means-assisting member.

Figure 10:
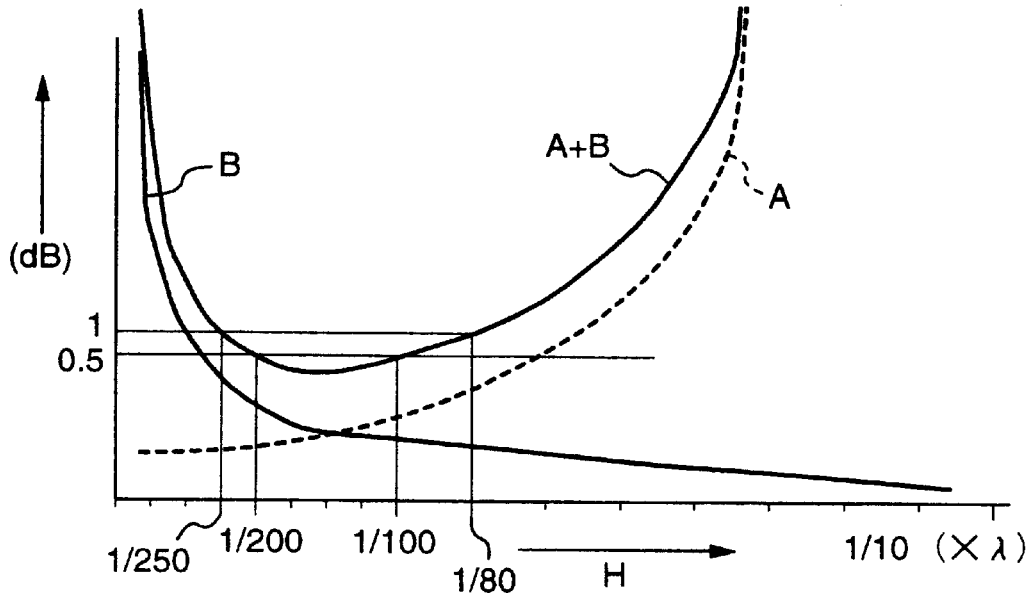
FIG. 10 is a graph showing the correlation with the distance between pole plates and an antenna loss in the third embodiment.

Next, the thickness of the antenna 14 to be mounted on the box-like metal body 13*a* will be studied. FIG. 10 is a graph showing the correlation between the distance between the radiation elements and the ground plate and a loss of the antenna in the third embodiment of the invention.

In an antenna in which the distance between the antenna board 1 and the ground plate 6 is close as in the antenna of this embodiment, a copper loss (loss due to a heat loss of the copper element, which is indicated by B in FIG. 10) is in inverse proportion to the distance H (hereinafter, the distance H) between the ground plate 6 and the radiation elements 2 provided the width of the radiation element 2 is constant, and the loss decreases with the increase of the distance H. A radiation loss (loss due to radiation, which is indicated by A in FIG. 10), is in proportion to the distance H between the radiation elements 2 and the ground plate 6 provided the width of the radiation element 2 is constant, and the loss increases with the increase of the distance H. Usually, the receiving sensitivity of the antenna greatly varies, depending external factors, though it somewhat varies, depending on the intensity of the target radio waves and the corresponding frequency. Therefore, in order that the antenna can be kept in a usable condition under any circumstances, it is necessary that the internal loss (the sum of the copper loss and the radiation loss; A+B in FIG. 10) should be kept to the minimum. Generally, the allowable internal loss is not more than 1 dB, and particularly when transmitting and receiving weak radio waves in a satellite communication or the like, the allowable internal loss is not more than 0.5 dB. In view of this, the distance H is as follows; $1\div250 \leqq H\div\lambda \leqq 1\div80$, and preferably $1\div200 \leqq H\div\lambda \leqq 1\div100$ (where $\lambda$ represents a wavelength), the good antenna efficiency can be obtained, and therefore the antenna of high reliability can be provided which can positively operate under a wide range of conditions of use.

For example, in a mobile satellite communication system which effects a ground-satellite-ground data communication using a satellite orbiting in a low orbit, assume that this antenna 14 is used in Obcomb communication to which the frequency band between 137.0 MHz and 138.0 MHz for a down-line and the frequency band between 148.0 MHz and 150.05 MHz for an up-line are assigned in WARC' 92 (Meeting of World Radio communication Association, 1992). The range of variation of the wavelength ($\lambda$) is $2000 \leqq \lambda \leqq 2190$ (mm), and therefore good antenna characteristics can be achieved at all wavelength bands In the range in which the range of obtained with the shortest wavelength ($\lambda$=2000), overlaps the range H obtained with the longest wavelength ($\lambda$=2190). This range is $8.76 \leqq H \leqq 25$ (mm), and preferably $10.95 \leqq H \leqq 20$ (mm).

If the distance H is in the above range, the sum of the radiation loss and the copper loss is suppressed to the minimum, and therefore the antenna can be achieved which has a small loss and good antenna characteristics as a whole. Besides, the thickness of the antenna 14 is very small, and therefore the antenna can be easily installed on a container or the like designed to be used in a stacked condition. More specifically, when freight containers are stacked together, a gap, formed between the containers, is 1 to 2 inches at the largest, and when the antenna 14 is used for Obcomb communication, the antenna 14 can be easily formed into a thickness within this range. Therefore, the antenna can be achieved which being mounted on the container, enables the stacking of the containers. Besides, by short-circuiting the ground plate 6 and the box-like metal body of the container together, the change of antenna impedance can be suppressed to the minimum even when the container is stacked on the antenna 14, and therefore the antenna can be achieved which has good antenna characteristics even in a stacked condition.

Fourth Embodiment

Figure 27:
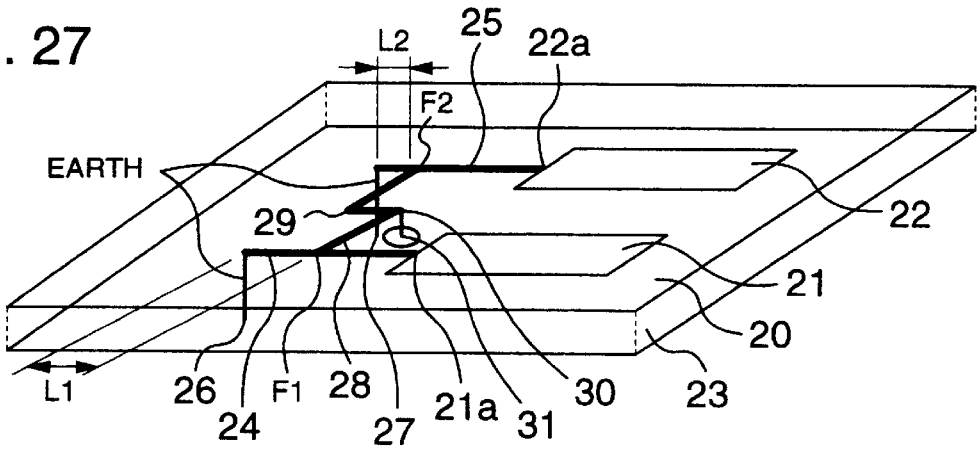
FIG. 27 is a perspective view showing the construction of an antenna according to a fourth embodiment of the invention.
Figure 28:
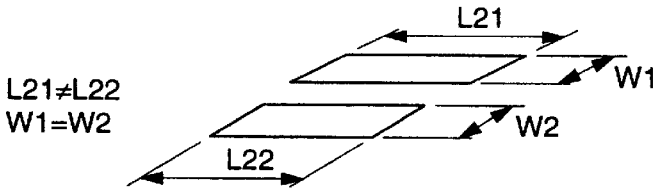
FIG. 28 is a perspective view showing the construction of radiation elements In the fourth embodiment.
Figure 29:
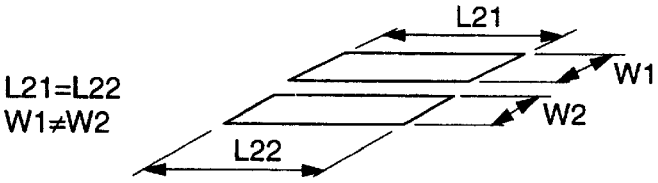
FIG. 29 is a perspective view showing the construction of radiation elements in the fourth embodiment.

Next, a fourth embodiment of the invention will be described with reference to the drawings. FIG. 27 is a perspective view showing the construction of an antenna of the fourth embodiment, and FIGS. 28 and 29 are perspective views showing the construction of radiation elements in the fourth embodiment.

In FIG. 27, an antenna board 20 is usually made of a dielectric material, and comprises a printed circuit board, a PET film board or the like having a conductor layer formed on one or both sides thereof, and radiation elements 21 and 22 with different electrical lengths are formed on these boards by etching method. With respect to the electrical length of the radiation elements 21 and 22, the line lengths L21 and L22 of the radiation elements 21 and 22 may be different from each other while their line widths W are the same, as shown in FIG. 28. Alternatively, the line widths W1 and W2 of the radiation elements may be different from each other while their line lengths are the same, as shown in FIG. 29. In either case, preferably, the element line length of each of the radiation elements is set to about ¼ of a respective one of a plurality of line wavelengths λg1, λg2, . . . λgn corresponding to a plurality of desired frequencies f1, f2, . . . fn.

A transmission line 24 is connected to an end 21*a* of the radiation element 21, and a transmission line 25 is connected to an end 22*a* of the radiation element 22. The transmission line 24 connects the radiation element 21 to a ground point 26 grounded to a ground plate 23 disposed substantially parallel to the radiation elements 21 and 22, and the transmission line 25 connects the radiation element 22 to a ground point 27 grounded to the ground plate 23. Preferably, the transmission lines 24 and 25 are connected respectively to central portions of the ends 21*a* and 22*a* since this enhances antenna characteristics. The ground plate 23 may be provided on that side of the antenna board 20 facing the opposite side thereof having the radiation elements 21 and 22 formed, or the ground plate 23 may be provided separately in substantially parallel relation to the antenna board 20.

A transmission line 28 is connected at a feed point F1 to the transmission line 24, and a transmission line 29 is connected at a feed point F2 to the transmission line 25. The transmission lines 28 and 29 are respectively connected to a common transmission line 30 (extending from the ground plate 23) through a feed portion 31, and feed high-frequency power in a matched manner to the radiation elements 21 and 22 via the feed points F1 and F2 through transmission lines 24 and 25. Although the transmission line 30 is disposed i-substantially vertically relative to both of the ground plate 23 and the antenna board 20, the transmission line 30 and the feed portion 31 may be both formed on the antenna board 20.

The distance L1 between the ground point 26 and the feed point F1 is different from the distance L2 between the ground point 27 and the feed point F2, and by doing so, the impedance matching can be accurately achieved, and therefore the antenna device can be provided in which the resonance frequency is not shifted in the radiation elements 21 and 22, and which can shared between two wavelengths.

If the lengths of the transmission lines 27 and 28 are different from each other, the feed phase can be adjusted more easily.

Coaxial cables, micro-strip transmission lines or the like can be used as the transmission lines 24, 25, 28, 29 and 30.

In this embodiment, although only one feed portion 31 is provided, two separate feed portions may also be possible.

In this embodiment, although only two radiation elements are provided, more than two radiation elements can be of course provided.

Figure 32:
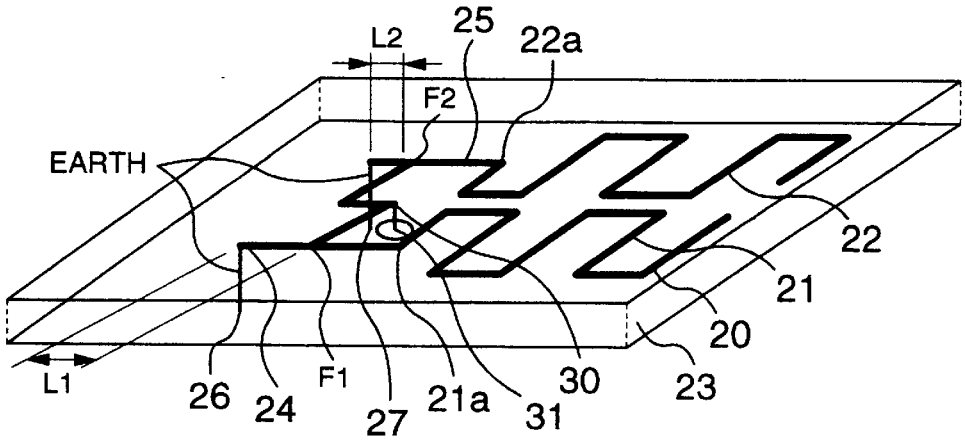
FIG. 32 is a perspective view showing the construction of an antenna according to the fourth embodiment.

The radiation elements 21 and 22 may be formed into a meandering line as shown in FIG. 32, or may be formed into any other suitable configuration. With the construction of the radiation elements 21 and 22 shown in FIG. 27, the dimension of each of the radiation elements 21 and 22 in the transverse direction can be reduced, and therefore the size of the antenna can be reduced, and therefore the antenna device, having a narrow, elongate configuration, can be achieved. With the construction of the radiation elements 21 and 22 shown in FIG. 32, the length of the radiation elements 21 and 22 in the longitudinal direction can be reduced, and therefore there can be achieved the antenna device of a compact design having a smaller projected area.

Figure 36:
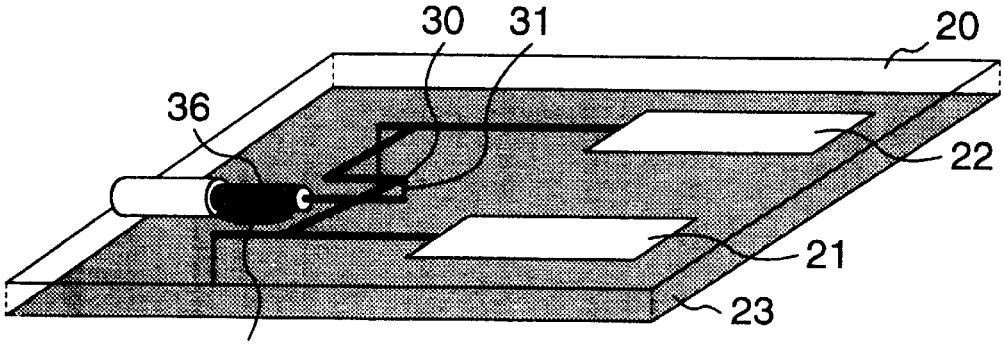
FIG. 36 is a perspective view showing the construction of a feed portion in the fourth embodiment of the invention.

As shown in FIG. 36 (which is a perspective view showing the construction of a feed portion of the invention), a construction may be possible in which a coaxial feeder cable 36, connected to the transmission line 31, is provided between the ground plate 23 and the antenna board 20 in substantially parallel relation thereto. With this construction, the antenna can have a thinner design as compared with the case where a connector is exposed at the reverse surface of the ground plate 23.

Figure 37:
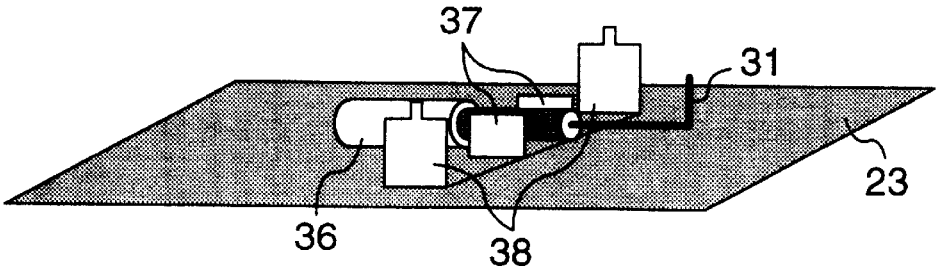
FIG. 37 is an enlarged view showing the feed portion in the fourth embodiment.

As shown in FIG. 37 (which is an enlarged, perspective view showing a feed portion of the invention), a metal member of an integral construction may be provided which includes braid-clamping portions 37 for clamping a braid of a coaxial feeder cable 36, and ground line portions 38 for grounding the radiation elements 21 and 22 via transmission lines 24 and 25. This metal member may be electrically connected to the ground plate by soldering or welding. In this construction, the structural portion, having the braid-clamping portions 37 (which receive the braid of the coaxial cable 36 therebetween, and are deformed by a tool (e.g. pliers) to hold this cable therebetween), is formed integrally with the ground line portions 38 for grounding the radiation elements 21 and 22 to the ground board 23 each of the ground line portions 38 having a soldering projection formed at its upper end. Therefore, the number of the component parts is reduced, and the assembling process is simplified, thus enhancing the productivity, besides the reliability is enhanced since the number of the connected and processed portions is reduced.

Figure 38:
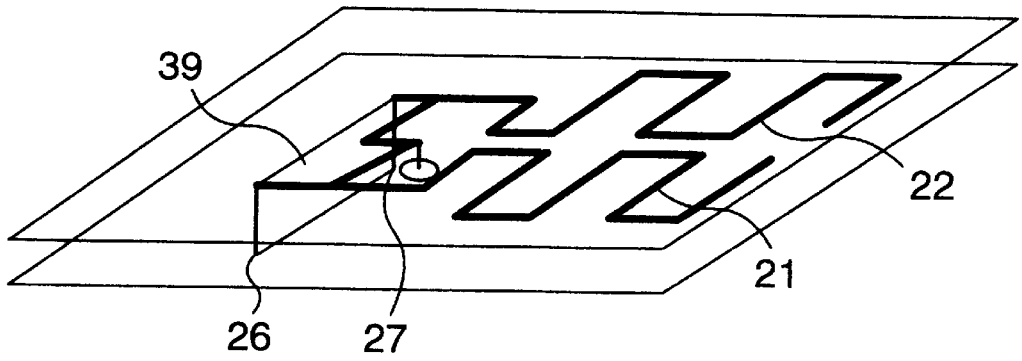
FIG. 38 is a perspective view showing the grounding of the radiation elements in the fourth embodiment.

As shown in FIG. 38 (which is a perspective view showing a grounded form of radiation elements in the invention), a construction may be provided in which a plurality of ground points 26 and 27 are grounded to the ground plate 23 by a wall 39 made of electrically-conductive metal. With this construction, the area of grounding is increased, and the electrical operation which is stable for noises can be effected, besides the mechanical strength of the structure increases.

Figure 39:
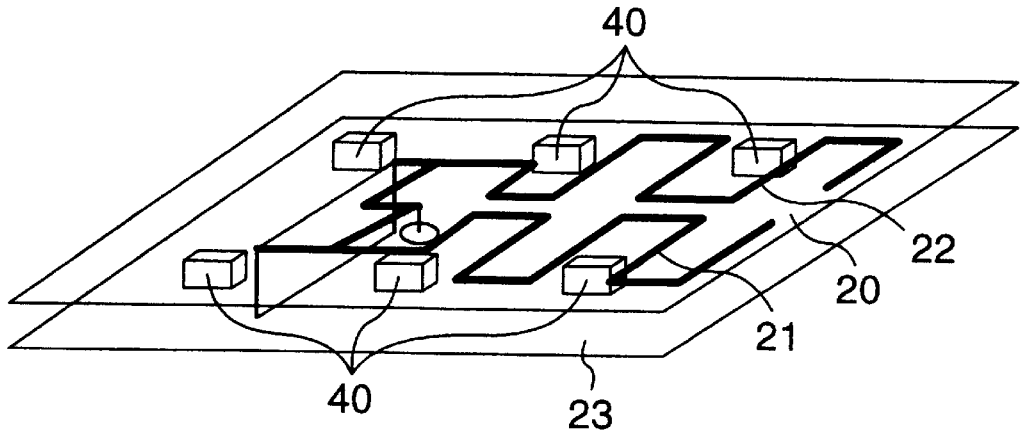
FIG. 39 is a perspective view showing the construction of the antenna device of the fourth embodiment.

As shown in FIG. 39 (which is a perspective view showing the construction of an antenna device of the invention), a construction may be provided in which the plurality of radiation elements 21 and 22 are formed on the common antenna board 20, and a gap between the antenna board 20 and the ground plate 23 is maintained by spacers 40 made of a resin or the like. Owing to the provision of the spacers 40, the gap between the antenna board 20 and the ground plate 23 can be kept to a predetermined height, and the antenna device having stable antenna characteristics can be provided. In this construction, although the spacers 40 are provided in spaced relation to one another, a single board, made of a dielectric material, may be inserted in the gap.

The operation of the antenna of the above construction will be described.

The high-frequency power, supplied via the transmission line 31, is supplied to the radiation elements 21 and 22 via the feed portion 30, the transmission lines 28 and 29, the feed points F1 and F2, the transmission lines 24 and 25 and the ends 21*a* and 22*a* of the radiation elements 21 and 22. By setting the distance L1 between the ground point 26 and the feed point F1 and the distance L2 between the ground point 27 and the feed point F2 to different desired lengths, respectively, the power can be fed in a matched manner so that the desired impedance can be obtained. By suitably selecting the dimension of the each portion of the radiation elements 21 and 22, the radiation elements 21 and 22 radiate radio waves into the air at the desired resonance frequencies f1 and f2. In this case, as shown in FIG. 27, if the electrical length of the radiation element 21 is represented by Le1, and the electrical length of the radiation element 22 is represented by Le2, the following formulas are provided:

$$Le1 \approx C/4f1 \quad \text{(Formula 1)}$$

$$Le2 \approx C/4f2 \quad \text{(Formula 2)}$$

Figure 30:
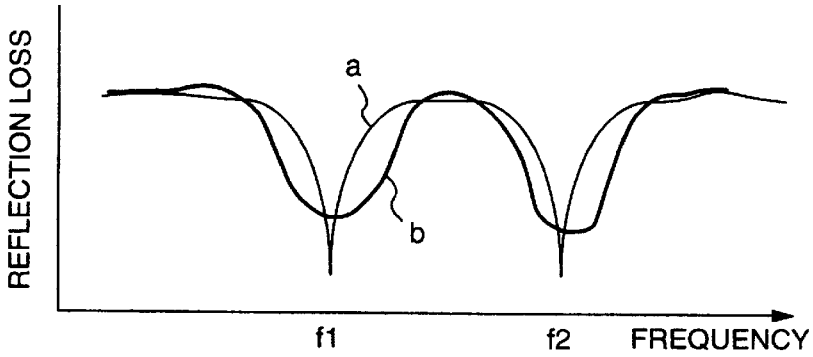
FIG. 30 is a diagram showing characteristics of the radiation elements in the fourth embodiment.

A plurality of resonance characteristics are obtained (two cycles in the case) as shown in FIG. 30 (which is a diagram showing the characteristics of the radiation elements in the fourth embodiment of the invention).

Figure 31A:
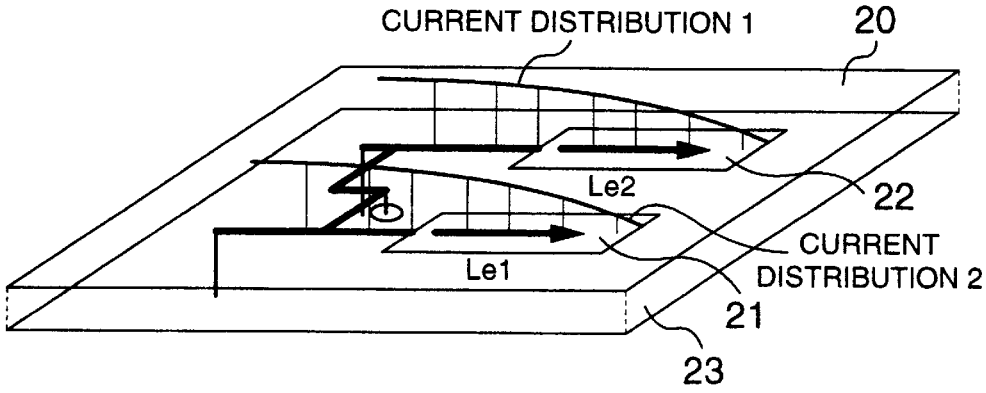
FIGS. 31A and 31B are illustrations showing a current distribution In the antenna of the fourth embodiment.
Figure 31B:
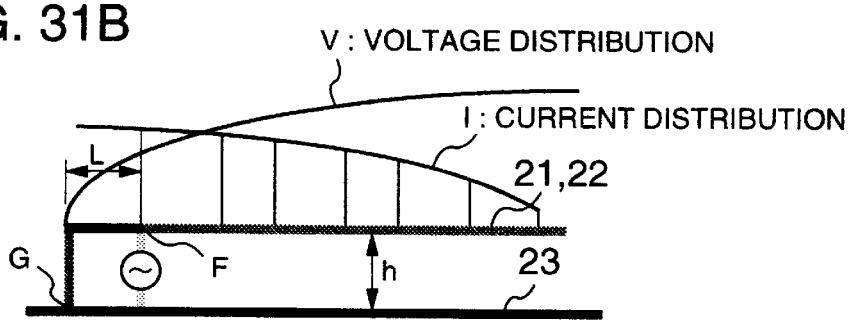

The current distribution I in the antenna of the above construction will be described with reference to FIGS. 31A and 31B. FIGS. 31A and 31B are views showing the current distribution in the antenna of the fourth embodiment of the invention. As shown in FIG. 31A, the electrical length Le1, Le2 of each of the radiation elements 21 and 22 is set to about ¼ of a respective one of the two line wavelengths λg1 and λg2 corresponding to the desired frequencies f1 and f2, and by doing so, the current is distributed generally half sinusoidally in the antenna in such a manner that the amplitude is the maximum in the vicinity of the central portion of the feed portion at the desired frequencies f1 and f2 while the amplitude is the minimum at the distal end portions of the radiation elements. As indicated by arrows (→) in the drawings, the direction of the current, flowing in a horizontal direction on the drawing sheet, is horizontal, and horizontally-polarized radio waves due to this current are radiated. In this case, the potential of the voltage distribution V is the minimum at the ground point, and is the maximum at the free end of the radiation element, as shown in FIG. 31(*b*). Therefore, the impedance Z at the feed point F is expressed by the following formula:

$$Z = V \div I \quad \text{(Formula 3)}$$

Here, the gap between the ground plate and the radiation elements is represented by h. As shown in FIG. 31B, by adjusting the distance between the ground point G and the feed point F, that is, by varying L, the values of the voltage distribution V and current distribution I are varied at that point (position) in accordance with the change of L. Namely, the impedance Z. representing the ratio of the voltage distribution V to the current distribution I, can also be adjusted by varying the distance L between the ground point G and the feed point F. As shown in FIG. 27, in the case where the resonance occurs at the two frequencies f1 and f2, the impedance Z1, Z2 can be adjusted for each of the frequencies f1 and f2 by adjusting the distance L1 between the ground point G and the feed point F1 and the distance L2 between the ground point G and the feed point F2 for each of the frequencies f1 and f2. Therefore, the matching with the impedance Z0 of the feeder, such as a coaxial cable, can be achieved.

Fifth Embodiment

Figure 33A:
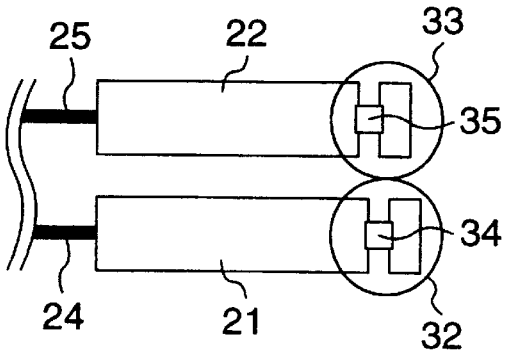
FIGS. 33A and 33B are plan views showing the construction of radiation elements in a fifth embodiment of the invention.
Figure 33B:
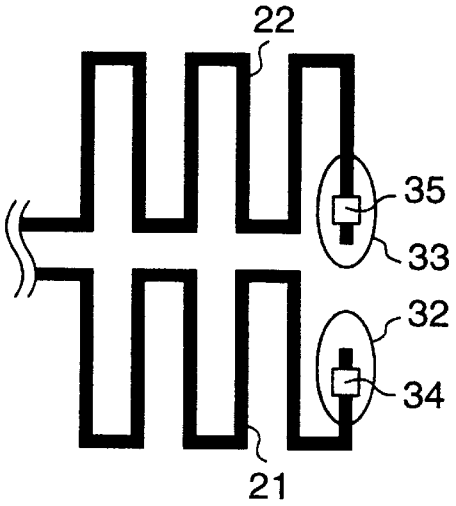

Next, a fifth embodiment of the invention will be described with reference to the drawings. Those portions of the antenna device of this embodiment, which are not described, are almost similar to those of the fourth embodiment. FIGS. 33A and 33B are plan view showing the construction of radiation elements of the fifth embodiment, and the radiation elements in these Figures are different only in configuration. As shown in FIGS. 33A and 33B, impedance devices 34 and 35 are provided at free end portions 32 and 33 of the radiation elements 21 and 22, respectively, and by setting these impedance values to desired values, respectively, the voltage standing wave ratio (VSWR) in a wide-band pattern can be obtained as indicated by a line b in FIG. 30. The desired results can be obtained if the impedance device is provided at one of the radiation elements. With this construction, even if slight variations are developed in the mass-produced antennas, the antenna characteristics can be kept within the predetermined range, and the antenna device, which is less liable to be defective during production, can be achieved. Besides, the antenna device of high reliability can be achieved in which the degradation of the antenna characteristics is extremely low even when snow, rain, dirt and so on deposits on the surface of the antenna device.

Figure 34A:
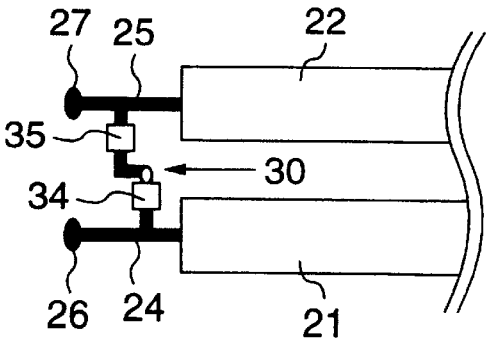
FIGS. 34A and 34B are plan views showing the construction of radiation elements in the fifth embodiment.
Figure 34B:
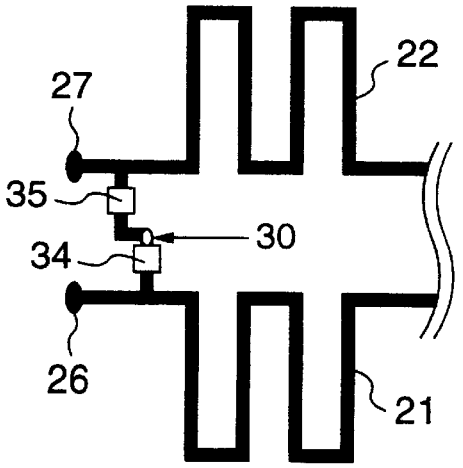
Figure 35:
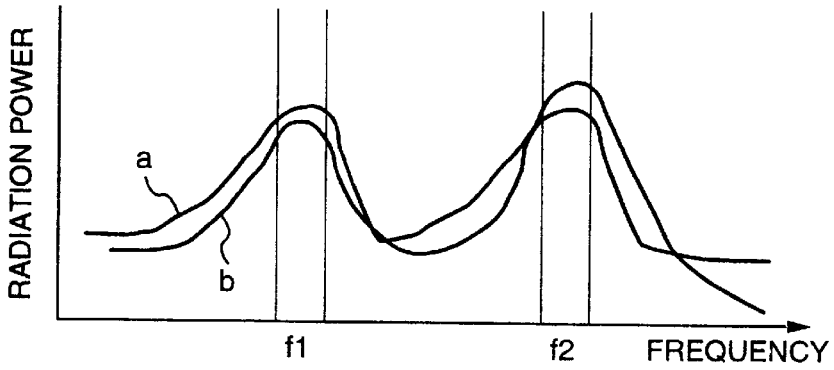
FIG. 35 is a diagram showing the relation between radiation power and frequencies in the fifth embodiment.

As shown in FIGS. 34A and 34B (which are plan views showing the construction of radiation elements of the invention), the impedance devices 34 and 35 are provided in the vicinity of feed points F1 and F2 at one or both sides, and by doing so, similar effects can be obtained. More specifically, generally, in the vicinity of the feed points F1 and F2, the value of the voltage distribution V is small, and the value of the current distribution I is large, and the impedance Z, representing the ratio of the voltage distribution V and the current distribution I, decreases (usually, several tens Ω, from Z≈5 to 75Ω). Therefore, the impedance devices 34 and 35 are provided in the vicinity of the feed points F1 and F2, and their impedance values are set to desired values, respectively, and by doing so, the VSWR in a wide-band pattern can be obtained. Besides, by setting the values of the impedance devices 34 and 35 to desired values, respectively, the radiation power can be varied arbitrarily. For example, a solid line a in FIG. 35 (which shows the relation between the radiation power and the frequency in the invention) represents the radiation power obtained when the impedance devices 34 and 35 are substantially the same in impedance device ratio, and a broken line B represents the radiation power obtained when the impedance devices 34 and 35 are not equal in impedance device ratio. Thus, in accordance with the demand of the radio system, the radiation power at the frequencies f1 and f2, that is, the antenna gain, can be adjusted. Besides, using the above constructions in combination, the antenna device can be provided which has a wider band and adjustable in antenna gain.

What is claimed is:

1. An antenna device comprising radiation elements, feed means for feeding electric power to said radiation elements, a ground plate provided in electrically-spaced relation to said radiation elements, and a cover member covering said radiation elements and said feed means, said antenna device having at least one value defined as the ratio of H÷Λ obtained by dividing a distance (H) in mm between said radiation elements and said ground plate by a wavelength (Λ) in mm of at least one frequency transmitted or received by said antenna device, wherein:

said wavelength (Λ) is a value in the range 2000 mm to 2190 mm and said wavelength Λ and said distance H satisfy the relation $1 \div 250 \leqq H \div \Lambda \leqq 1 \div 80$, with the result that said distance H is a value in the range 8.76 mm to 25 mm.

2. An antenna device according to claim 1, in which said radiation elements comprise at least first and second radiation elements, and said first and second radiation elements each accommodate a plurality of frequencies distinguished from each other.

3. An antenna device according to claim 1, in which the power is fed to said radiation elements from said feed means.

4. An antenna device according to claim 1, in which each of said radiation elements is formed by a meandering line.

5. An antenna device according to claim 4, in which the length of said meandering line is determined by said wavelength (Λ) corresponding to a predetermined frequency.

6. An antenna device according to claim 4, in which the line length of each meandering line is set to about ¼ of a respective one of a plurality of line wavelengths corresponding to a plurality of desired frequencies.

7. An antenna device according to claim 4, in which a width of said radiation element of the meandering line in a main polarization direction is larger than a width of said radiation element in a polarization direction perpendicular to said main polarization direction.

8. An antenna device according to claim 4, in which an inductance device is provide at a free end portion of said meandering line.

9. An antenna device according to claim 1, in which mounting holes are formed in said ground plate.

10. An antenna device according to claim 1, in which said radiation elements are disposed closer to said cover member than to said ground plate.

11. An antenna device comprising radiation elements, feed means for feeding electric power to said radiation elements, a ground plate provided in electrically-spaced relation to said radiation elements, and a cover member covering said radiation elements and said feed means, said antenna device having at least one value defined as the ratio of $H \div \Lambda$ obtained by dividing a distance (H) in mm between said radiation elements and said ground plate by a wavelength (Λ) in mm of at least one frequency transmitted or received by said antenna device, wherein:

said wavelength (Λ) is a value in the range 2000 mm to 2190 mm and said wavelength Λ and said distance H satisfy the relation $1 \div 250 \leqq H \div \Lambda \leqq 1 \div 80$, with the result that said distance H is a value in the range 8.76 mm to 25 mm, and said antenna device further comprises a support member provided between an antenna board, having said radiation elements formed thereon, and said ground plate.

12. An antenna device according to claim 11, in which said antenna board is disposed closer to said cover member than to said ground plate.

13. An antenna device comprising a first radiation element, a second radiation element different in electrical length from said first radiation element, a first feed point for feeding electric power to said first radiation element, a second feed point for feeding electric power to said second radiation element, and a ground plate provided in spaced relation to said first radiation element and said second radiation element, said first radiation element being grounded to said ground plate at a first ground point, and said second radiation element being grounded to said ground plate at a second ground point, the distance between said first ground point and said first feed point being different from the distance between said second ground point and said second feed point.

14. An antenna device according to claim 13, in which widths of said first and second radiation elements are equal to each other while lengths thereof are different from each other, so that an electrical length of said first radiation element is different from an electrical length of said second radiation element.

15. An antenna device according to claim 14, in which lengths of said first and second radiation elements are equal to each other while widths thereof are different from each other, so that an electrical length of said first radiation element is different from an electrical length of said second radiation element.

16. An antenna device according to claim 13, in which an impedance device is provided at a free end portion of a radiation element.

17. An antenna device according to claim 13, in which an impedance device is provided at a feed point.

18. An antenna device according to claim 14, in which a feeder, connected to feed means for feeding the electric power both to said first and second feed points, comprises a coaxial cable, and said coaxial cable is provided between said ground plate and said first and second radiation elements, and is disposed generally parallel to said ground plate and said first and second radiation elements.

19. An antenna device according to claim 18, in which a single metal member of an integral construction is provided including a clamp portion for clamping said coaxial cable, a first ground line portion extending from said first ground point of said first radiation element to said first feed point, and a second ground line portion extending from said second ground point of said second radiation element to said second feed point, and said metal member is electrically connected to said ground plate.

20. An antenna device according to claim 13, in which said first ground point and said second ground point are grounded to said ground plate through a metal wall.

21. An antenna device according to claim 13, in which said first radiation element and said second radiation element are formed on a common printed circuit board.

22. An antenna device according to claim 13, in which each of said first radiation element and said second radiation element is formed by a meandering line, and an element length of said meandering line element is set to about ¼ of a corresponding line wavelength.

* * * * *